US011719042B1

(12) United States Patent
MacKarvich

(10) Patent No.: US 11,719,042 B1
(45) Date of Patent: Aug. 8, 2023

(54) FALL ARREST SHOCK DAMPENER

(71) Applicant: Charles J. MacKarvich, Atlanta, GA (US)

(72) Inventor: Charles J. MacKarvich, Atlanta, GA (US)

( * ) Notice: Subject to any disclaimer, the term of this patent is extended or adjusted under 35 U.S.C. 154(b) by 0 days.

(21) Appl. No.: 17/672,058

(22) Filed: Feb. 15, 2022

(51) Int. Cl.
*E06C 7/18* (2006.01)

(52) U.S. Cl.
CPC ..... *E06C 7/186* (2013.01)

(58) Field of Classification Search
CPC ... E06C 7/186; E06C 7/48; E06C 7/18; E06C 7/182; E06C 7/187; A62B 35/00; A62B 35/0093; F16F 15/10; F16F 15/12; F16F 15/1201
See application file for complete search history.

(56) References Cited

U.S. PATENT DOCUMENTS 1,467,597 A 9/1923 Wendel
1,470,489 A * 10/1923 Schuh ..... E06C 1/345 182/206
2,140,828 A * 12/1938 Carle ..... E06C 1/36 248/214
2,526,071 A 10/1950 Estey
3,012,626 A * 12/1961 Marryatt ..... E06C 9/14 182/84
3,100,026 A * 8/1963 Sunshine ..... E06C 7/484 182/214
3,115,211 A * 12/1963 Ostrander, Jr. ..... E06C 7/12 187/241
3,523,591 A * 8/1970 Fountain ..... E06C 7/187 182/8
3,598,200 A 8/1971 Thompson
3,902,700 A 9/1975 Cox
3,908,791 A 9/1975 Kleine et al.
3,910,378 A * 10/1975 Nyman ..... E06C 7/48 182/103
4,085,818 A * 4/1978 Swager ..... E06C 7/187 182/8
RE30,072 E * 8/1979 Kleine ..... E06C 7/186 182/8
4,193,475 A 3/1980 Sweet et al.
4,399,890 A 8/1983 Bartels et al.
(Continued)

FOREIGN PATENT DOCUMENTS

DE 202013006653 10/2013
FR 3054592 2/2018

OTHER PUBLICATIONS

US 11,261,665 B2, 03/2022, Mackarvich (withdrawn)
(Continued)

*Primary Examiner* — Colleen M Chavchavadze
*Assistant Examiner* — Shiref M Mekhaeil
(74) *Attorney, Agent, or Firm* — Taylor English Duma LLP

(57) ABSTRACT

A fall arrest device can include a fall arrest base including a torsion biasing element defining an axis; and a fall arrest arm rotatably secured to the torsion biasing element of the fall arrest base, the fall arrest arm biased towards an unloaded position of the fall arrest arm by the torsion biasing element and configured to rotate about the axis of the torsion biasing element and against the bias of the torsion biasing element when the fall arrest arm is loaded towards a loaded position.

14 Claims, 20 Drawing Sheets

(56) References Cited

U.S. PATENT DOCUMENTS 4,546,855 A * 10/1985 Lyons ..... E06C 7/182 182/8
4,709,783 A 12/1987 Tomioka et al.
5,265,696 A * 11/1993 Casebolt ..... A62B 35/04 182/8
5,497,848 A 3/1996 Travis
5,664,640 A * 9/1997 Smith ..... A62B 1/14 182/5
5,743,356 A * 4/1998 Mitchell ..... E06C 7/48 182/229
5,845,741 A * 12/1998 Dwyer ..... E06C 9/08 182/95
5,911,287 A * 6/1999 Campbell ..... E06C 7/12 182/103
5,918,698 A 7/1999 Lunn
5,934,408 A * 8/1999 Flux ..... A62B 1/14 182/5
5,975,242 A 11/1999 Woller et al.
5,992,564 A * 11/1999 Kirkpatrick ..... E04G 5/10 182/117
6,161,647 A * 12/2000 Braden ..... A62B 35/0062 182/8
6,244,551 B1 * 6/2001 Fletcher ..... E06C 7/486 52/11
6,296,105 B1 * 10/2001 Carnes ..... B65G 45/16 198/499
6,533,069 B1 * 3/2003 Couillard ..... E06C 7/48 182/83
6,578,665 B1 6/2003 Debaca et al.
6,722,469 B1 * 4/2004 Weger, Jr. ..... E06C 7/48 248/210
6,769,513 B2 * 8/2004 Pettit ..... E06C 7/081 182/115
6,907,957 B1 * 6/2005 Couch ..... E06C 1/36 182/83
6,926,120 B1 * 8/2005 Bradley ..... E06C 7/16 182/129
7,044,270 B1 * 5/2006 McIntire ..... E06C 7/18 182/206
7,066,299 B1 * 6/2006 Fleming ..... E06C 7/48 182/127
7,093,689 B2 8/2006 Poldmaa
7,600,610 B2 * 10/2009 Deuer ..... F03D 80/50 182/8
7,637,350 B2 * 12/2009 Conroy ..... E06C 5/04 182/93
7,950,497 B2 * 5/2011 Horton ..... E06C 7/16 182/107
7,992,681 B2 * 8/2011 Anderson ..... E06C 7/182 182/106
8,074,769 B2 * 12/2011 Sracic ..... E06C 1/12 182/103
D669,194 S * 10/2012 Meyer ..... D25/64
8,353,387 B2 * 1/2013 Vollenweider ..... E06C 7/187 182/8
8,602,163 B2 * 12/2013 Davis, Jr. ..... E06C 7/48 182/106
8,783,415 B2 * 7/2014 Bancroft ..... E06C 7/188 182/45
8,839,907 B2 * 9/2014 Davis, Jr. ..... E06C 7/48 182/106
D715,964 S 10/2014 Von Hebestreit
8,875,839 B1 * 11/2014 Licea ..... E06C 7/186 182/8
9,080,383 B2 7/2015 Meillet
9,500,028 B2 * 11/2016 Cale ..... E06C 1/397
9,540,875 B2 * 1/2017 Ellis ..... E06C 7/182
9,784,034 B2 * 10/2017 Short ..... A62B 35/0093
D810,960 S 2/2018 Umlor
9,988,842 B2 * 6/2018 Moss ..... E06C 7/186
D830,577 S 10/2018 Umlor
10,486,002 B1 * 11/2019 Drinkwater ..... E06C 7/18
10,883,310 B2 * 1/2021 Johnson ..... E06C 7/48
10,940,338 B1 3/2021 Miller et al.
11,085,238 B1 * 8/2021 Bancroft ..... E06C 7/486
11,136,824 B2 10/2021 James, Jr.
11,313,174 B2 * 4/2022 MacKarvich ..... E06C 7/186
11,492,849 B2 11/2022 Mackarvich
2003/0230389 A1 * 12/2003 Savard ..... E05D 13/1261 160/133
2005/0045421 A1 * 3/2005 Gaines ..... E06C 7/482 182/107
2007/0158137 A1 7/2007 Petersen
2007/0278037 A1 12/2007 Michel et al.
2008/0190692 A1 * 8/2008 Feik ..... E06C 7/182 182/107
2008/0202850 A1 * 8/2008 Anderson ..... E06C 7/48 182/106
2009/0000868 A1 * 1/2009 Gaines ..... E06C 7/482 182/106
2010/0012424 A1 * 1/2010 Krauss ..... A62B 35/04 182/3
2010/0326768 A1 12/2010 Kerstei, Jr.
2012/0080263 A1 * 4/2012 Lee ..... E06C 1/345 182/8
2013/0233993 A1 * 9/2013 Striepling ..... E06C 7/188 248/309.1
2015/0075907 A1 * 3/2015 Moss ..... E06C 7/48 182/129
2015/0204140 A1 7/2015 Umlor et al.
2015/0226002 A1 8/2015 Johansen
2015/0252619 A1 9/2015 Kramer
2017/0058604 A1 * 3/2017 Minette ..... E06C 7/48
2017/0058605 A1 * 3/2017 Napolitano ..... E06C 7/488
2018/0274295 A1 9/2018 Adams et al.
2019/0169934 A1 * 6/2019 Adams ..... E06C 9/02
2019/0257152 A1 * 8/2019 MacKarvich ..... E06C 7/48
2019/0330921 A1 * 10/2019 James, Jr. ..... E06C 7/48
2019/0338593 A1 * 11/2019 Knickrehm ..... A62B 35/005
2021/0046340 A1 * 2/2021 Miller ..... A62B 35/005
2021/0147155 A1 * 5/2021 Collier ..... B65G 45/16
2021/0222392 A1 * 7/2021 Miller ..... E02F 3/3618
2021/0238924 A1 8/2021 Mackarvich
2021/0238925 A1 * 8/2021 MacKarvich ..... E06C 7/48
2021/0372200 A1 * 12/2021 Walsh ..... E06C 7/186
2022/0227588 A1 * 7/2022 Collier ..... B65G 45/16
2022/0389760 A1 12/2022 Mackarvich

OTHER PUBLICATIONS

US 11,459,825 B2, 10/2022, Mackarvich (withdrawn)
Mackarvich, Charles J.; Applicant-Initiated Interview Summary for U.S. Appl. No. 17/075,879, filed Oct. 21, 2020, dated Apr. 20, 2022, 3 pgs.
Mackarvich, Charles J.; Notice of Allowance for U.S. Appl. No. 17/075,879, filed Oct. 21, 2020, dated May 19, 2022, 15 pgs.
Mackarvich, Charles J.; Applicant-Initiated Interview Summary for U.S. Appl. No. 17/075,879, filed Oct. 21, 2020, dated Nov. 12, 2021, 2 pgs.
Mackarvich, Charles J.; Applicant-Initiated Interview Summary for U.S. Appl. No. 17/075,879, filed Oct. 21, 2020, dated Jun. 10, 2021, 2 pgs.
Mackarvich, Charles J.; Final Office Action for U.S. Appl. No. 17/075,879, filed Oct. 21, 2020, dated Mar. 24, 2021, 21 pgs.
Mackarvich, Charles J.; Non-Final Office Action for U.S. Appl. No. 17/075,879, filed Oct. 21, 2020, dated Jan. 28, 2022, 22 pgs.
Mackarvich, Charles J.; Notice of Pre-AIA or AIA Status for U.S. Appl. No. 17/075,879, filed Oct. 21, 2020, dated Oct. 22, 2021, 5 pgs.
Mackarvich, Charles J.; Requirement for Restriction/Election for U.S. Appl. No. 17/075,879, filed Oct. 21, 2020, dated Jan. 4, 2021, 8 pgs.
3M; Instruction Manual for LAD-SAF Flexible Cable Vertical Safety Systems, Copyright 2019, 225 pgs.
Mackarvich, Charles J.; Applicant-Initiated Interview Summary for U.S. Appl. No. 17/075,942, filed Oct. 21, 2020, dated Jun. 15, 2021, 2 pgs.

(56) References Cited

OTHER PUBLICATIONS

Mackarvich, Charles J.; Applicant-Initiated Interview Summary for U.S. Appl. No. 17/075,942, filed Oct. 21, 2020, dated Sep. 10, 2021, 3 pgs.
Mackarvich, Charles J.; Non-Final Office Action for U.S. Appl. No. 17/075,879, filed Oct. 21, 2020, dated Mar. 12, 2021, 16 pgs.
Mackarvich, Charles J.; Non-Final Office Action for U.S. Appl. No. 17/075,942, filed Oct. 21, 2020, dated Mar. 16, 2021, 14 pgs.
Mackarvich, Charles J.; Non-Final Office Action for U.S. Appl. No. 17/075,942, filed Oct. 21, 2020, dated Jul. 19, 2021, 19 pgs.
Mackarvich, Charles J.; Notice of Allowance for U.S. Appl. No. 17/075,942, filed Oct. 21, 2020, dated Oct. 20, 2021, 18 pgs.
Mackarvich, Charles J.; Requirement for Restriction/Election for U.S. Appl. No. 17/075,942, filed Oct. 21, 2020, dated Jan. 12, 2021, 9 pgs.
Mackarvich, Chades J.; Supplemental Notice of Allowance for U.S. Appl. No. 17/075,942, filed Oct. 21, 2020, dated Nov. 23, 2021, 8 pgs.
OCM; Specification Sheet for Coil Wing Nut, publicly available prior to Feb. 3, 2020, 1 pg.
Mackarvich, Chades J.; Requirement for Restriction/Election for U.S. Appl. No. 17/578,311, filed Jan. 18, 2022, dated Feb. 24, 2022, 9 pgs.
Rosta; Article entitled: "Technology", located at <https://rosta.com/technology-rosta/>, accessed on Jun. 22, 2021, 6 pgs.
Mackarvich, Charles J.; Non-Final Office Action for U.S. Appl. No. 17/890,999, filed Aug. 18, 2022, dated Mar. 20, 2023, 40 pgs.

* cited by examiner

FALL ARREST SHOCK DAMPENER

TECHNICAL FIELD

Field of Use

This disclosure relates to fall arrest systems. More specifically, this disclosure relates to fall arrest systems for use with ladders, including portable ladders.

Related Art

Ladders are commonly used to reach portions of an elevated structure not otherwise accessible. Ladders are useful for reaching such an elevated structure to, for example only, perform maintenance and repair on or around the elevated structure. Ladders are sometimes used only temporarily and therefore can be portable. Portable ladders— especially in an extended condition where the elevated structure is quite high off the ground—are not generally fixed to either the ground or to the elevated structure. Such ladders generally depend on gravity, friction, and the care taken by the user of the ladder for their proper orientation and footing and resulting stability under varying loads. Where available, a fall arrest system can prevent a user's misstep from turning into a serious injury or worse; however, such a system is usually not available or practical for some types of ladders including the aforementioned portable ladders. Even when available, a fall arrest system can arrest the user's fall too suddenly, which can be too jarring for the user.

Once a ladder is used to access an elevated structure, passing through, over, or around the ladder and safely descending to a surface of the elevated structure can present its own challenges, especially when a parapet is defined at or near an edge of the elevated structure.

SUMMARY

It is to be understood that this summary is not an extensive overview of the disclosure. This summary is exemplary and not restrictive, and it is intended to neither identify key or critical elements of the disclosure nor delineate the scope thereof. The sole purpose of this summary is to explain and exemplify certain concepts of the disclosure as an introduction to the following complete and extensive detailed description.

In one aspect, disclosed is a fall arrest device comprising: a fall arrest base comprising a torsion biasing element defining an axis; and a fall arrest arm rotatably secured to the torsion biasing element of the fall arrest base, the fall arrest arm biased towards an unloaded position of the fall arrest arm by the torsion biasing element and configured to rotate about the axis of the torsion biasing element and against the bias of the torsion biasing element when the fall arrest arm is loaded towards a loaded position.

In a further aspect, disclosed is a fall arrest system comprising: a ladder dock comprising a mounting panel configured to be mounted to an elevated structure, the ladder dock defining a notch sized to receive and fix a position of a ladder with respect to the ladder dock; and a fall arrest device secured to the ladder dock and comprising: a fall arrest base comprising a torsion biasing element defining an axis, the fall arrest base secured to the ladder dock; and a fall arrest arm rotatably secured to the torsion biasing element of the fall arrest base, the fall arrest arm biased towards an unloaded position of the fall arrest arm by the torsion biasing element and configured to rotate about the axis of the torsion biasing element and against the bias of the torsion biasing element when the fall arrest arm is loaded towards a loaded position.

In yet another aspect, disclosed is a method comprising: securing an upper anchor of a fall arrest system to an elevated structure, the upper anchor comprising a torsion biasing element; securing a ladder to the elevated structure proximate to the upper anchor; and extending a cable from the upper anchor to a lower anchor of the fall arrest system, the cable configured to receive a cable sleeve configured to tether a user to the cable, the cable further configured to allow movement of the cable sleeve to any position between the upper anchor and the lower anchor.

Various implementations described in the present disclosure may comprise additional systems, methods, features, and advantages, which may not necessarily be expressly disclosed herein but will be apparent to one of ordinary skill in the art upon examination of the following detailed description and accompanying drawings. It is intended that all such systems, methods, features, and advantages be included within the present disclosure and protected by the accompanying claims. The features and advantages of such implementations may be realized and obtained by means of the systems, methods, features particularly pointed out in the appended claims. These and other features will become more fully apparent from the following description and appended claims, or may be learned by the practice of such exemplary implementations as set forth hereinafter.

BRIEF DESCRIPTION OF THE DRAWINGS

The accompanying drawings, which are incorporated in and constitute a part of this specification, illustrate several aspects of the disclosure and together with the description, serve to explain various principles of the disclosure. The drawings are not necessarily drawn to scale. Corresponding features and components throughout the figures may be designated by matching reference characters for the sake of consistency and clarity.

DETAILED DESCRIPTION

Figure 1A:
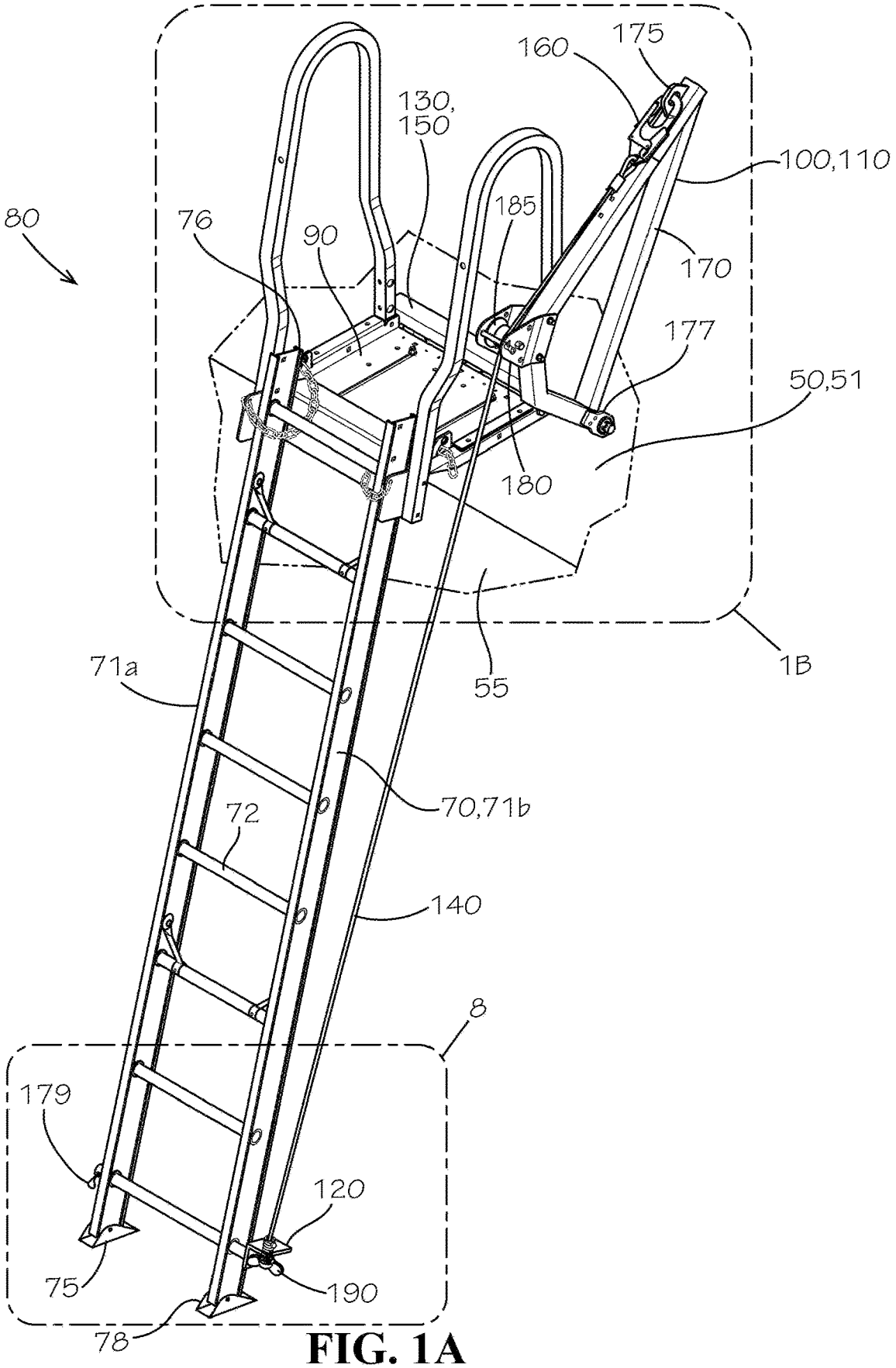
FIG. 1A is a front perspective view of a fall arrest system comprising a ladder dock, a fall arrest device comprising an upper anchor and a lower anchor, a cable extending from the upper anchor to the lower anchor, and a ladder in accordance with one aspect of the current disclosure.

The present disclosure can be understood more readily by reference to the following detailed description, examples, drawings, and claims, and their previous and following description. However, before the present devices, systems, and/or methods are disclosed and described, it is to be understood that this disclosure is not limited to the specific devices, systems, and/or methods disclosed unless otherwise specified, as such can, of course, vary. It is also to be understood that the terminology used herein is for the purpose of describing particular aspects only and is not intended to be limiting.

The following description is provided as an enabling teaching of the present devices, systems, and/or methods in their best, currently known aspect. To this end, those skilled in the relevant art will recognize and appreciate that many changes can be made to the various aspects described herein, while still obtaining the beneficial results of the present disclosure. It will also be apparent that some of the desired benefits of the present disclosure can be obtained by selecting some of the features of the present disclosure without utilizing other features. Accordingly, those who work in the art will recognize that many modifications and adaptations to the present disclosure are possible and can even be desirable in certain circumstances and are a part of the present disclosure. Thus, the following description is provided as illustrative of the principles of the present disclosure and not in limitation thereof.

As used throughout, the singular forms "a," "an" and "the" include plural referents unless the context clearly dictates otherwise. Thus, for example, reference to a quantity of one of a particular element can comprise two or more such elements unless the context indicates otherwise. In addition, any of the elements described herein can be a first such element, a second such element, and so forth (e.g., a first widget and a second widget, even if only a "widget" is referenced).

Ranges can be expressed herein as from "about" one particular value, and/or to "about" another particular value. When such a range is expressed, another aspect comprises from the one particular value and/or to the other particular value. Similarly, when values are expressed as approximations, by use of the antecedent "about" or "substantially," it will be understood that the particular value forms another aspect. It will be further understood that the endpoints of each of the ranges are significant both in relation to the other endpoint, and independently of the other endpoint.

For purposes of the current disclosure, a material property or dimension measuring about X or substantially X on a particular measurement scale measures within a range between X plus an industry-standard upper tolerance for the specified measurement and X minus an industry-standard lower tolerance for the specified measurement. Because tolerances can vary between different materials, processes and between different models, the tolerance for a particular measurement of a particular component can fall within a range of tolerances.

As used herein, the terms "optional" or "optionally" mean that the subsequently described event or circumstance may or may not occur, and that the description comprises instances where said event or circumstance occurs and instances where it does not.

The word "or" as used herein means any one member of a particular list and also comprises any combination of members of that list. The phrase "at least one of A and B" as used herein means "only A, only B, or both A and B"; while the phrase "one of A and B" means "A or B."

To simplify the description of various elements disclosed herein, the conventions of "left," "right," "front," "rear," "top," "bottom," "upper," "lower," "inside," "outside," "inboard," "outboard," "horizontal," and/or "vertical" may be referenced. Unless stated otherwise, "front" describes that end of the system and ladder nearest to and occupied by a user of the system when the user is climbing up the ladder; "rear" is that end of the system and ladder that is opposite or distal the front; "left" is that which is to the left of or facing left from the user climbing up the ladder and facing towards the front; and "right" is that which is to the right of or facing right from the same user climbing up the ladder and facing towards the front. "Horizontal" or "horizontal orientation" describes that which is in a plane extending from left to right and aligned with the horizon. "Vertical" or "vertical orientation" describes that which is in a plane that is angled at 90 degrees to the horizontal.

In one aspect, a fall arrest device and associated methods, systems, devices, and various apparatuses are disclosed herein. In one aspect, the fall arrest device can comprise an anchor and a cable. In one aspect, the fall arrest device can comprise a torsion biasing element. In one aspect, the fall arrest device can comprise a fall arrest arm.

FIG. 1A shows a front perspective view of a fall arrest system 80 in accordance with one aspect of the current disclosure. The fall arrest system 80 can comprise a ladder dock 90. The fall arrest system 80 can comprise a fall arrest device 100. The fall arrest system 80 can comprise a ladder 70, which can be configured to provide access to an elevated structure 50. As shown, the ladder 70 can be rigid and portable. As shown, the ladder 70 can be configured to lean against a vertical, first, or outer side surface 55 or other surface of the elevated structure 50 or against a structure such that the ladder 70 can provide access to the elevated structure 50. More specifically, the ladder 70 can define a pair of rails 71*a,b* and a plurality of ladder rungs 72. The pair of rails 71*a,b* can extend from a lower end or first end 75 of the ladder to a upper end or second end 76 of the ladder 70 distal from the first end 75, and each of the plurality of ladder rungs 72 can extend from a first rail 71*a* of the pair of rails 71*a,b* to a second rail 71*b* of the pair of rails 71*a,b*. Feet 78, which can be adjustable, can be attached to and can stabilize the rails 71*a,b* and the first end 75 or a base of the ladder 70 and the ladder 70 generally on a lower surface 2001 (shown in FIG. 17). The feet 78 can be configured to rotate and sit flat on even uneven ground and/or penetrate the ground to further secure the ladder 70. In some aspects, the ladder 70 can be permanently secured to the elevated structure 50 and need not lean at angle against the elevated structure 50. The ladder 70 can and typically will extend above a surface 51 of the elevated structure 50 by a minimum distance. This minimum distance can be, for example and without limitation, 36 inches (approximately 914 millimeters).

The fall arrest device 100 of the fall arrest system 80 can comprise either or both of an upper anchor 110 and a lower anchor 120. The lower anchor 120 can be assembled to and optionally, as shown, nested within or about the ladder 70 and, more specifically, the lower end 75 thereof. The lower anchor 120 can be secured to the ladder 70 with a mounting fastener 179. The upper anchor 110 can be assembled, directly or indirectly, to the surface 51 of the elevated structure 50 and can be configured to be secured to the elevated structure 50 proximate to the upper end 76 of the ladder 70. In some aspects, as shown, the upper anchor 110 can comprise or be assembled to the ladder dock 90, which itself can be assembled to the surface 51 of the elevated structure 50. In some aspects, the upper anchor 110 can comprise or be assembled to a fall arrest base 130, which can itself be assembled to or form a portion of the ladder dock 90 and, more generally, the fall arrest device 100 and the fall arrest system 80. In some aspects, the upper anchor 110 can be directly assembled to the surface 51 of the elevated structure 50. The fall arrest base 130 can comprise a torsion biasing element 150, which can define an axis 151 (shown in FIG. 1B). In some aspects, the torsion biasing element 150 can be a biasing element; and, in some aspects, the biasing element can be a tension biasing element (for example, extending from a rear side of a fall arrest arm 170 and a rear of the ladder dock 90 distal from the ladder 70 shown in FIG. 1A) or a compression biasing element (for example, extending from a front side of the fall arrest arm 170 and a front of the ladder dock 90 proximate to the ladder 70 shown in FIG. 1A).

The upper anchor 110 can comprise the fall arrest arm 170, which can be configured to at least temporarily move when loaded by a force such as a force the upper anchor 110 can experience when a user connected to the fall arrest system 80 begins to fall and thereby engage the system 80. The fall arrest arm 170 can be rotatably secured to the torsion biasing element 150 of the fall arrest base 130. The fall arrest arm 170 can be biased towards an unloaded position (shown here and in FIG. 14A) of the fall arrest arm 170 by the torsion biasing element 150. The fall arrest arm 170 can be configured to rotate about the axis 151 of the torsion biasing element 150 and against the bias or biasing of the torsion biasing element 150 when the fall arrest arm 170 is loaded towards a loaded position (shown in FIG. 14B). More specifically, a pivot portion 177 of the fall arrest arm 170 can engage the torsion biasing element 150 and can be configured to rotate about the axis 151. In some aspects, the fall arrest arm 170 and, more generally, the upper anchor 110 and the fall arrest device 100 can absorb shock more slowly—in other words, can decelerate more slowly a user using the fall arrest system 80—than other fall arrest methods. The upper anchor 110 in particular facilitates such a result by allowing the fall arrest arm 170 to pivot a distance (across a range of movement 1207 shown in FIG. 12, for example) more proportionate to the distance traveled by the user during a fall and in contrast to a distance of just a few inches that a linear shock absorber may provide.

The fall arrest device 100 and, more specifically, the upper anchor 110 can comprise a cable guide 180. The cable guide 180 can be secured to or form part of either of the fall arrest base 130 and the fall arrest arm 170. The cable guide 180 can be positioned to guide and, in some aspects, support a cable 140 of the fall arrest system 80. More specifically, the cable guide 180 can keep the cable 140 from moving to left or to the right with respect to the fall arrest arm 170. The cable guide 180 can keep the cable 140 away from the fall arrest arm 170 and the elevated structure 50. In some aspects, the cable guide 180 can allow the cable 140 to line up parallel to the ladder 70, as shown. The cable 140 can extend from an attachment portion 175 of the fall arrest arm 170, around the cable guide 180, and away from the fall arrest arm 170. The fall arrest arm 170 can be configured to contact the cable 140 at only at the attachment portion and the cable guide. In some aspects, the cable guide 180 can comprise a roller 185, which can be configured to rotate about an axis thereof. In some aspects, the cable guide 180 can comprise a non-rotating standoff.

The cable 140, which can be a fall arrest cable, can be formed from a metallic material and can be solid, stranded, or braided in construction. The cable 140 can extend from the lower anchor 120 or the first end 75—or a portion proximate to the first end 75—of the ladder 70 to the upper anchor 110 or the second end 76—or a portion proximate to the second end 76—of the ladder 70. More specifically, the cable 140 can extend along or substantially along a longitudinal direction of the ladder 70 and can be offset at least slightly from the ladder 70. As a position of either of the lower anchor 120 and the upper anchor 110 is adjusted, a tension in the cable 140 can be maintained by use of a cable attachment 160 proximate to or incorporated into the upper anchor 110 and/or a cable attachment 190 proximate to or incorporated into the lower anchor 120. In some aspects, either of the cable attachments 160,190 can comprise a clip like shown for the cable attachment 160. In some aspects, either of the cable attachments 160,190 can comprise a more complex—and adjustable—mechanism like the cable attachment 190 shown. In any case, as will be described below with respect to at least FIG. 15, a user of the ladder 70 can connect himself or herself to the cable 140 and thereby receive passive fall protection. The fall arrest arm 170 can be offset from a line of symmetry or centerline 601 (shown in FIG. 18) of the ladder dock 90 or, more generally, the fall arrest system 80. As shown, the fall arrest arm 170 of the fall arrest device 100 can be positioned outside of a space configured for passage of a user of the system, such passage being generally aligned or centered about a center of the ladder 70.

Figure 1B:
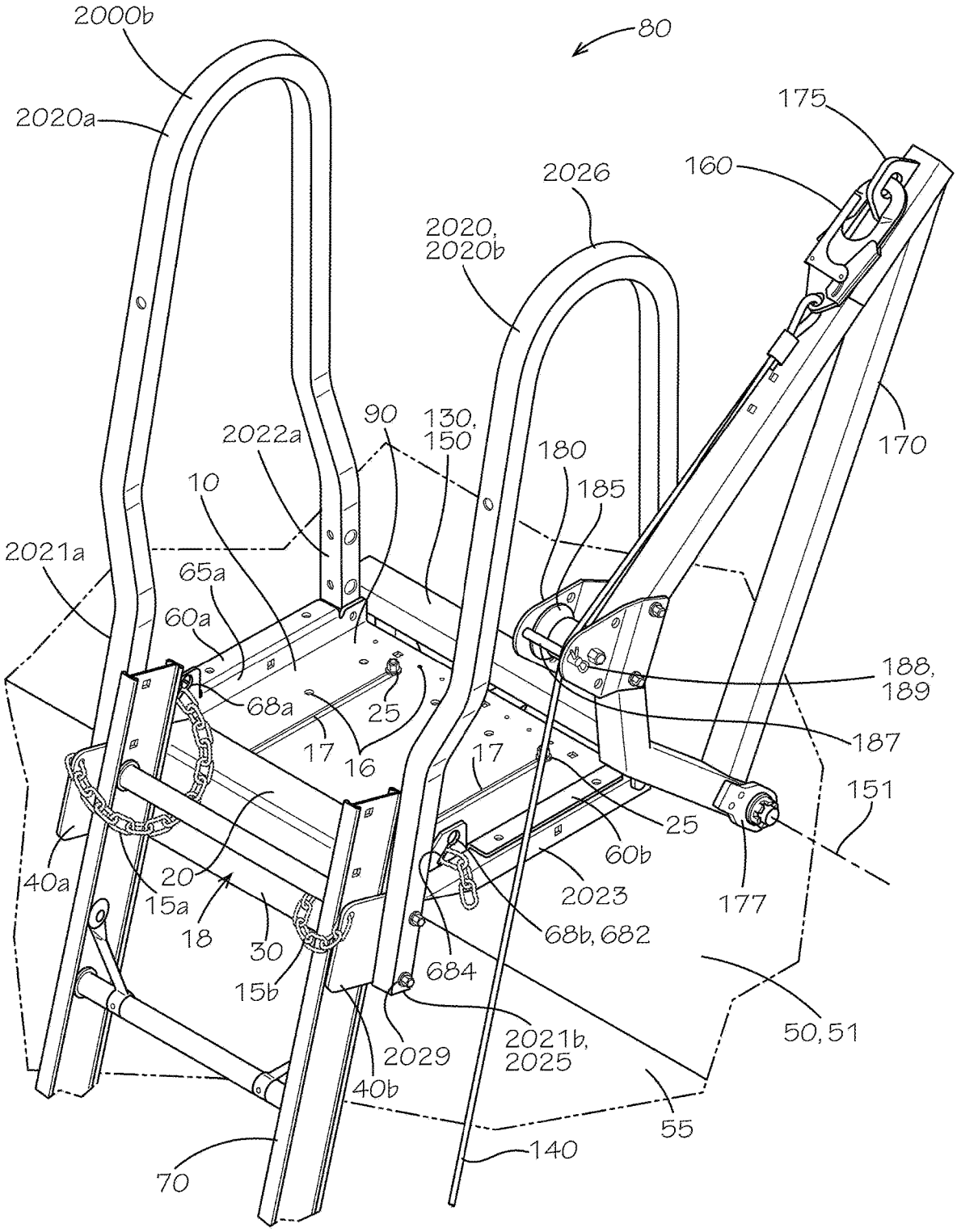
FIG. 1B is a detail front perspective view of the fall arrest system of FIG. 1 taken from detail 1B of FIG. 1.

FIG. 1B is a detail front perspective view of the fall arrest system 80 of FIG. 1 taken from detail 1B of FIG. 1, which can comprise the ladder dock 90. The ladder dock 90 can comprise a mounting panel 10. The ladder dock 90 and, more specifically, the mounting panel 10 can define one or more openings such as, for example and without limitation, mounting openings 16,17 to facilitate attachment of the ladder dock 90 to the elevated structure 50. The ladder dock 90 can be attached to the elevated structure 50 using fasteners 25. In some aspects, including when the ladder dock 90 is secured to a parapet of the elevated structure 50, the fasteners 25 can secure the ladder dock 90 to a bracket 1210 (shown in FIG. 12) securing the ladder dock 90 to the elevated surface 51 from underneath the ladder dock 90. In some aspects, the openings 16,17 can be slotted openings to facilitate adjustment during assembly of the ladder dock to the elevated surface 51. In some aspects, the openings 16,17 can be square or circular openings. Various aspects of the fall arrest system 80 can be as shown in U.S. Patent Publication Nos. 2021/0238924 and/or 2021/0238925, published Aug. 5, 2021, each of which is hereby incorporated by reference in its entirety.

The ladder dock 90 can comprise a connecting panel 20. The ladder dock 90 can comprise a ladder rest panel 30. The ladder dock 90 can comprise ears 40*a,b*. As shown, the connecting panel 20 can extend from the mounting panel 10, the ladder rest panel 30 can extend from the connecting panel 20, and the ears 40*a,b* can extend from the ladder rest panel 30. As also shown, the upper anchor 110 (shown in FIG. 1A) can assemble to and optionally nest within or about the ladder dock 90. In some aspects, additional connecting panels 65*a,b* (65*b* shown in FIG. 11) can be bent at an angle with respect to the mounting panel 10. Likewise, auxiliary panels 60*a,b* can be bent at an angle with respect to the respective connecting panels 65*a,b* and with respect to the mounting panel 10 as desired to facilitate access to and use of openings 68*a,b* as well as to facilitate an interface with any neighboring portions of the ladder dock 90 or the elevated structure 50. Each of the retaining openings 68*a,b* can comprise or define a larger portion 682 and a smaller portion 684. In some aspects, the auxiliary panels 60*a,b* can be bent with respect to the mounting panel 10 at an angle. Any one or more portions of the ladder dock 90 including, for example and without limitation, the mounting panel 10, the connecting panel 20, the ladder rest panel 30, and the ears 40*a,b* can define a planar or flat shape and can define an upper or outside surface and a lower or inner surface. Any of these same portions can define a substantially planar or flat shape, with "substantially" meaning planar or flat except for local ridges, indentations, openings, and/or surface texture. In some aspects, the ladder dock 90 need not comprise the aforementioned panels and can comprise a frame defining frame members and other mounting structures to attach the ladder dock 90 to the elevated structure 50.

As shown, the ladder dock 90 and other portions of the fall arrest system 80 can be configured to be mounted to a substantially horizontal surface of the elevated structure 50 such as the surface 51. In some aspects, substantially horizontal can mean plus or minus 10 degrees from the horizontal. More generally, the surface 51 of the elevated structure 50 can be angled with respect to a vertical orientation of the ladder dock 90 and/or the elevated structure 50. The ladder dock 90 can define a notch 18, which can be sized to receive and fix a position of the ladder 70 with respect to the ladder dock 90. The fall arrest system 80 comprising the ladder dock 90 can comprise one or more retaining fasteners 15*a,b*, which can secure the ladder 70 to the ladder dock 90. More specifically, the retaining fasteners 15*a,b* can be secured to and extend from the ladder dock 90. In some aspects, as shown, the retaining fasteners 15*a,b* can be secured to the auxiliary panels 65*a,b*. In some aspects, the retaining fasteners 15*a,b* can be secured to and extend from any other portion of the ladder dock 90 or, more generally, the fall arrest device 100 such as, for example and without limitation, the mounting panel 10, the connecting panel 20, the ladder rest panel 30, or the ears 40*a,b*.

The cable guide 180 can comprise a retainer 187, which can prevent disengagement of the cable 140 from the cable guide 180. The retainer 187, which can comprise a pin as shown, can define a bore 188 and can comprise a retainer fastener 189 extending through the bore 188. The cable 140 can thus pass or extend between the roller 185 and the retainer 187 and disengage from the cable guide 180 only after removal of the retainer 187.

The fall arrest system 80, which can form a portion of a parapet descent apparatus 2000*b*, can comprise a handle or guide rail 2020—or handles or guide rails 2020*a,b*, which can extend vertically upward from the ladder dock 90. As shown, each of the guide rails 2020*a,b*—or, as with any other disclosed feature of the guide rails 2020*a,b*, a single guide rail 2020 in any position including those shown—can define a first end 2025 proximate to the ladder dock 90 and a second end 2026 distal from the ladder dock 90. Each of the guide rails 2020*a,b* can define a rail height 2024 (shown in FIG. 17) measured from a surface of the elevated structure 50 such as, for example and without limitation, the surface 51 and can be set to satisfy applicable ergonomic and/or safety requirements. As shown, the first end 2025 of the corresponding guide rail 2020*a,b* can comprise an end 2021*a,b* and an end 2022*a,b* (2022*b* shown in FIG. 18), either or both of which can be secured to the ladder dock 90. As shown, the ends 2021*a,b* can be secured to the respective ears 40*a,b* with fasteners 2029 and the ends 2022 can be secured with fasteners (not shown) to a portion of the ladder dock 90 distal from the ear 40*b* such as, for example and without limitation, the connecting panels 65*a,b*. Each of the guide rails 2020*a,b* can approximately define an upside-down "U" shape or "V" shape. In some aspects, as shown, a horizontal member 2023 can extend from the end 2021*a,b* to the end 2022*a,b*, and the corresponding guide rail 2020*a,b* can thereby form a closed shape.

Figure 2:
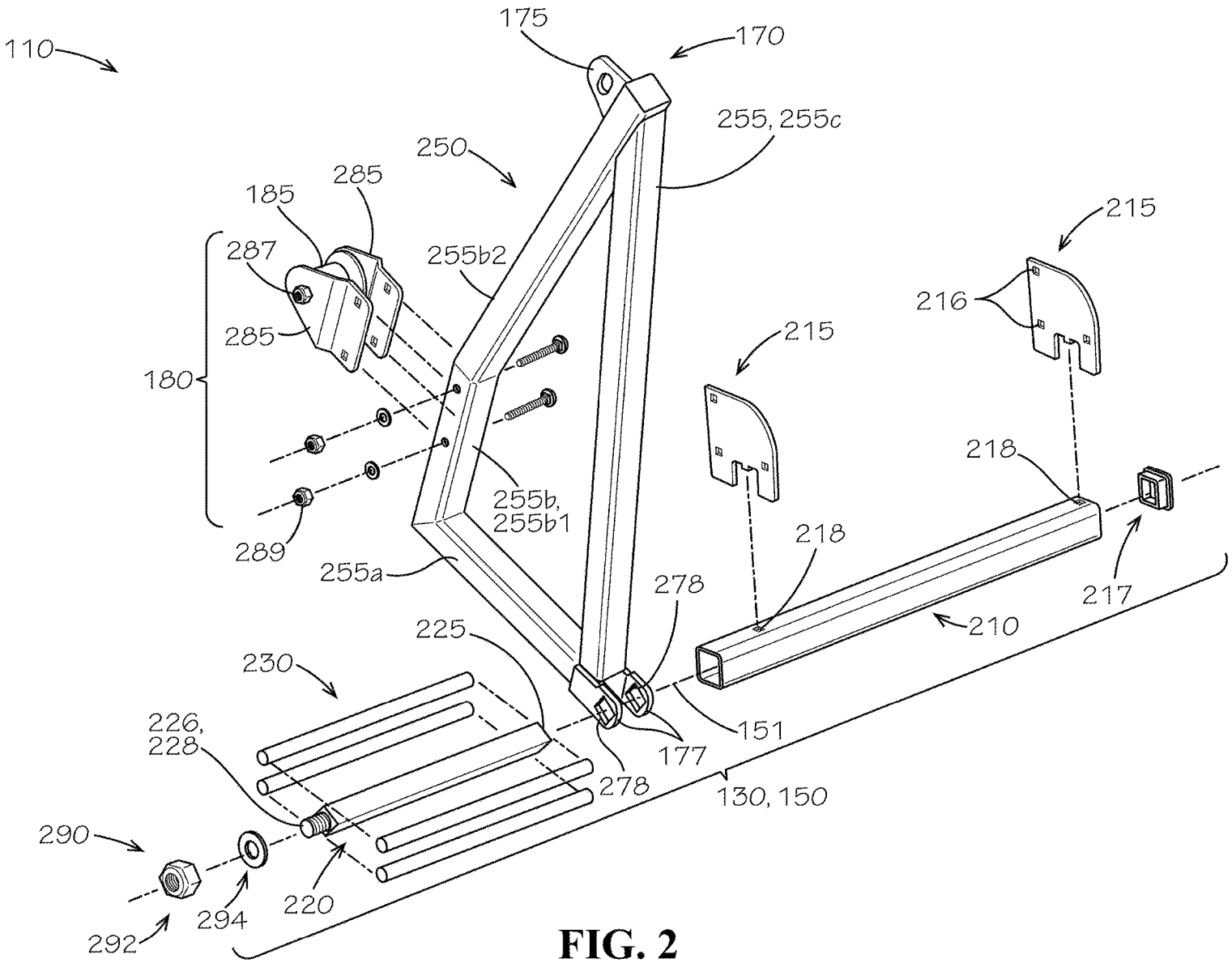
FIG. 2 is a rear exploded perspective view of the upper anchor of FIG. 1 showing a torsion biasing element and other portions thereof.

FIG. 2 is a rear exploded perspective view of the upper anchor 110 and, more specifically, the fall arrest base 130 and the fall arrest arm 170 of FIGS. 1A and 1B showing the torsion biasing element 150, the cable guide 180 and other portions thereof. The fall arrest arm can extend in one or more directions, each of which can be angled with respect to the axis 151.

The torsion biasing element 150 can comprise an outer housing or housing 210, which can be a hollow tube or other enclosure. A cross-section of the housing 210 can define a polygon in cross-section. The torsion biasing element 150 can comprise one or more brackets 215, which can be or can comprise plates. The one or more brackets 215 can be secured to the housing 210 and can secure the torsion biasing element 150 to an adjacent portion of the fall arrest system 80 (shown in FIG. 1A). More specifically, the brackets 215 can be at least partially received within openings 218 defined in the housing 210, which can help fix a location of the brackets 215. In some aspects, the one or more brackets 215 can be secured to the housing 210 with one or more fasteners (not shown). In some aspects, as shown, the one or more brackets 215 can be secured to the housing 210 by welding or by weldments. In some aspects, openings 216 can be defined in the brackets 215 and can secure the brackets 215 and, more generally, the torsion biasing element 150 and the upper anchor 110 to ladder dock 90 (shown in FIG. 1A) and/or the guide rails 2020*a,b* of the fall arrest system (shown in FIG. 1B). The torsion biasing element 150 can comprise a cap 217, which can enclose or cover one end of the housing 210 against intrusion of contaminating materials (e.g., solid or liquid contaminant) into the housing 210 or dislocation of components of the torsion biasing element 150 from the housing 210.

The torsion biasing element 150 can comprise a torsion shaft 220, which can be positioned inside the housing 210. The torsion shaft 220 can define a first end 225 and a second end 226, either or both of which can defined a threaded connection 228. A cross-section of the torsion shaft 220 can define a polygon in cross-section. The torsion biasing element 150 can comprise a fastener 290, which can secure a frame 250 of the fall arrest arm 170 to the torsion shaft 220. The fastener 290 can comprise a threaded connector 292 and, as desired, a washer 294 and can engage with the threaded connection 228. The threaded connector 292 can be or can comprise a nut and can be received about the threaded connection 228, including when the threaded connection 228 is a male threaded connection. More specifically, in some aspects, the threaded connector 292 can be a castle nut, which can prevent loosening of the connection between the fastener 290 and the torsion shaft 220. Including when the threaded connection 228 is a female threaded connection, the threaded connector 292 can be or can comprise a bolt and can be received within the threaded connection 228, which can be defined inside the torsion shaft 220. The torsion shaft 220 can comprise or can be formed from a strong, rigid material such as, for example and without limitation, steel. A length of the torsion shaft 220 and, more specifically, a length of the torsion shaft 220 not including any protruding portion of the threaded connection 228 can be equal to or less than a length of the housing 210. More specifically, a free end of the torsion shaft 220 distal from the fastener 290 need not extend the full length of the housing 210. In some aspects, a free end of the torsion shaft 220 need not be retained inside the housing 210 other than by friction. In some aspects, a fastener (not shown) can maintain a position of the free end of the torsion shaft 220 inside the housing 210.

The torsion biasing element 150 can comprise one or more cords 230. In some aspects, the torsion biasing element 150 can comprise at least three cords 230, each of which can be positioned adjacent to or alongside the torsion shaft 220 inside the housing 210. In some aspects, as shown, the torsion biasing element 150 can comprise four cords 230. Each of the cords 230 can comprise or can be formed form a resilient material such as, for example and without limitation, rubber and can thus be configured to deform under load and yet return to its original shape after the load is removed (i.e., the material forming each cord 230 can have a "memory"). A length of each cord 230 can be equal to or less than a length of the torsion shaft 220. Each of the torsion shaft 220 and the cords 230 can be enclosed completely within the housing 210. An overall length of the cord 230 inside the housing 210 or a length of the torsion shaft 220 inside the housing 210 can determine an amount of torsional biasing or resistance provided by the torsion biasing element 150. More specifically, a length of the torsion biasing element 150 comprising both the cord 230 and the torsion shaft 220 inside the housing 210 (i.e., where the cord 230 and the torsion shaft 220 are in contact with each other) can determine an amount of torsional biasing or resistance provided by the torsion biasing element 150.

Figure 11:
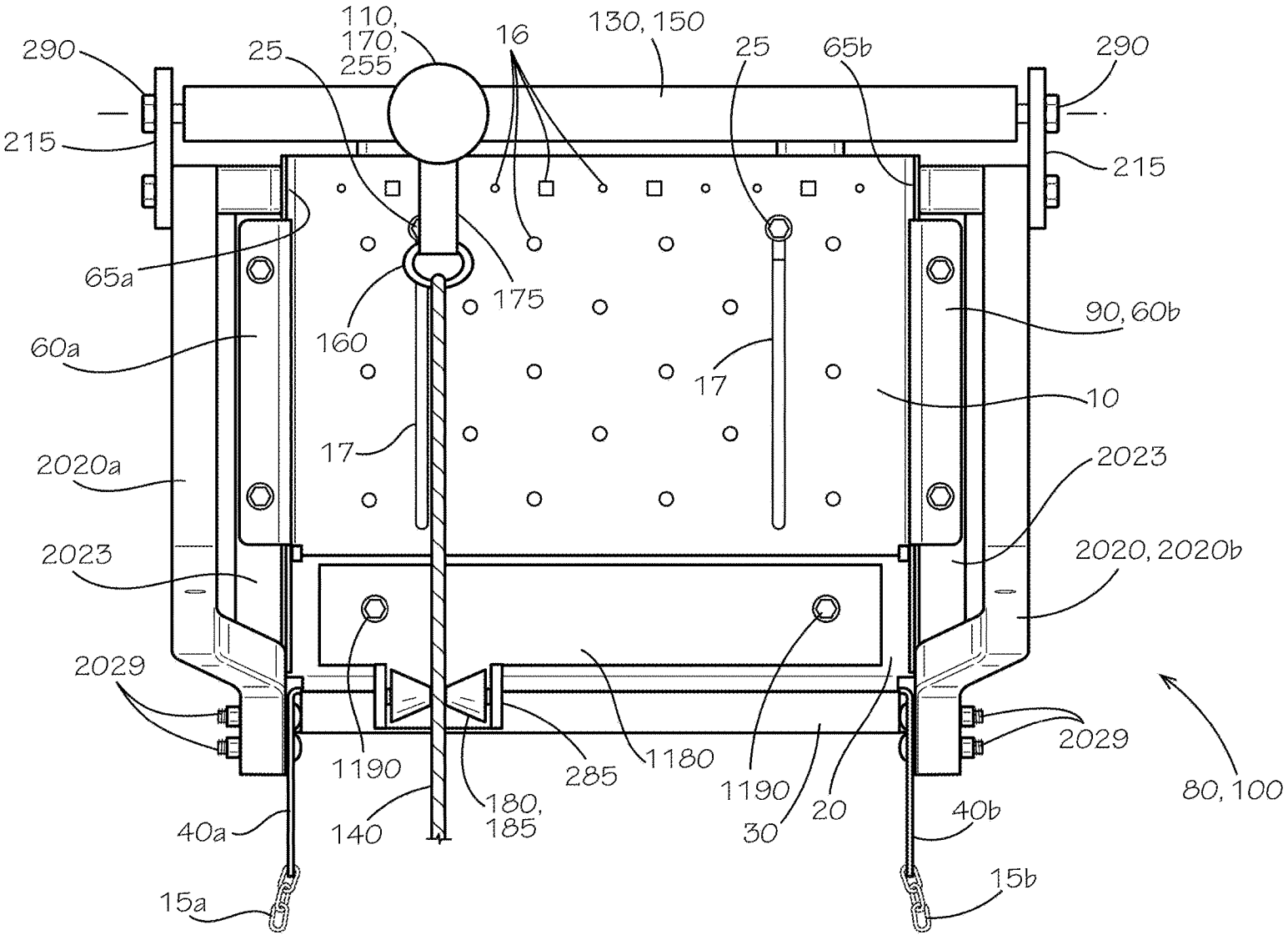
FIG. 11 is a top plan view of the fall arrest system of FIG. 1 comprising a fall arrest device comprising an upper anchor in accordance with another aspect of the current disclosure, with the upper anchor shown in the unloaded position and the ladder hidden for clarity.
Figure 12:
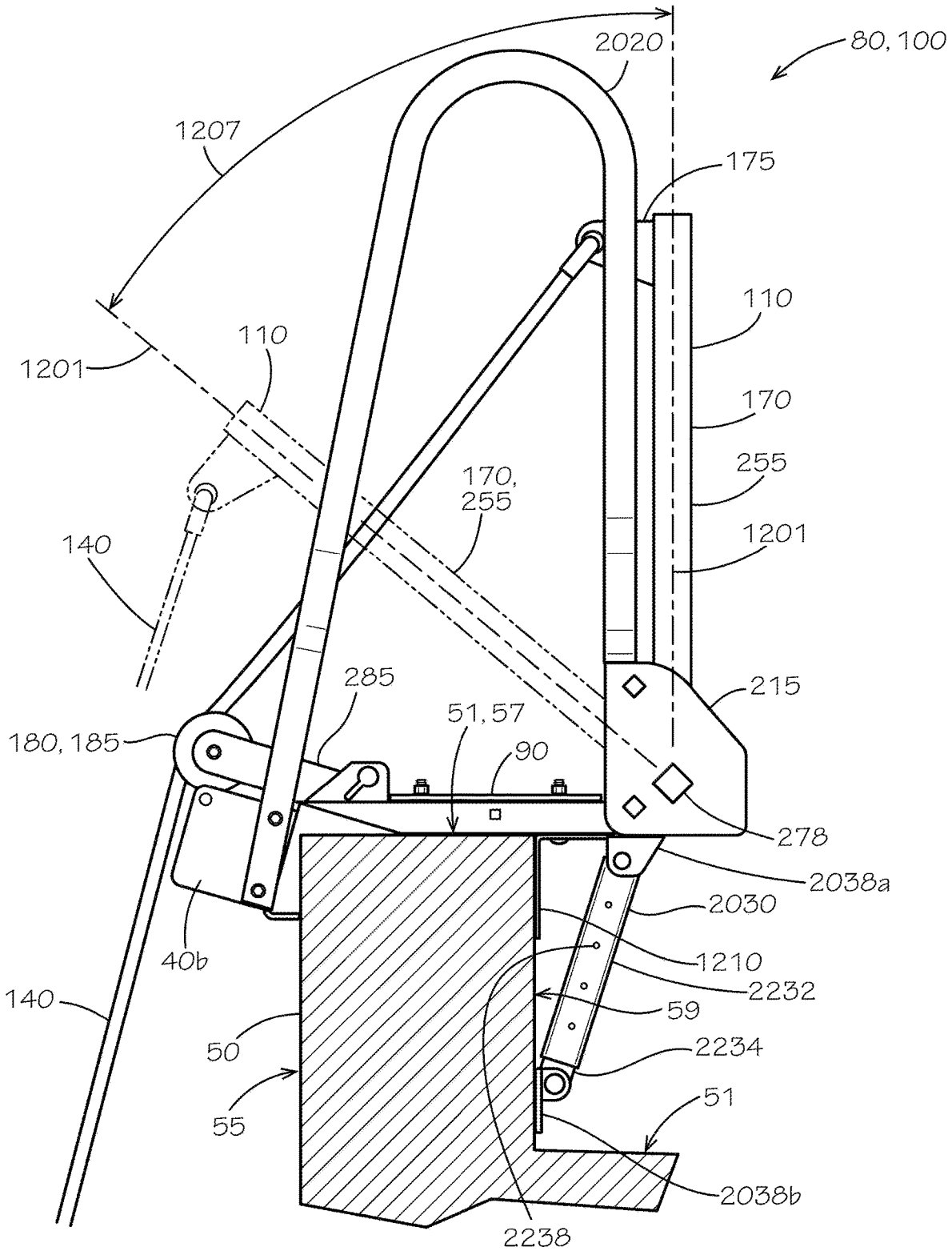
FIG. 12 is a side view of the fall arrest system and the fall arrest device of FIG. 11, again with the upper anchor shown in both the loaded and unloaded positions and the ladder again hidden for clarity.
Figure 13:
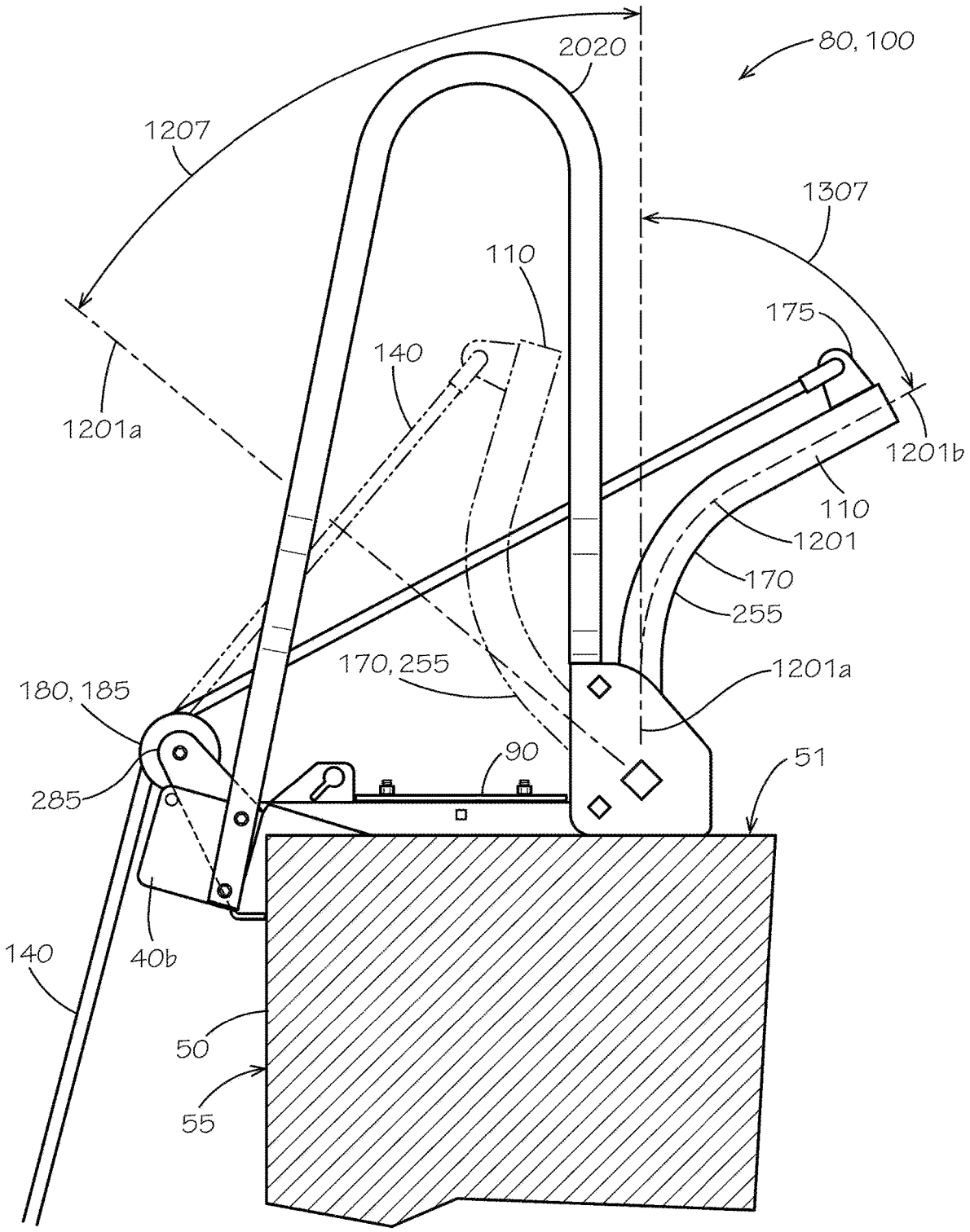
FIG. 13 is a side view of the fall arrest system and the fall arrest device of FIG. 11 in accordance with another aspect of the current disclosure, with the upper anchor again shown in the loaded and unloaded positions and the ladder again hidden for clarity.

The frame 250 of the fall arrest arm 170 can comprise one or more frame members 255. In some aspects, as shown, the frame can comprise a plurality of frame members 255 such as, for example and without limitation, frame members 255*a,b,c*, which can be joined to each other. In some aspects, a particular frame member such as the frame member 255*b* can comprise portions 255*b*1,b2. In some aspects, each of the frame members 255 can comprise or define a hollow tube. In some aspects, as shown, each of the frame members 255 can define a rectangular shape or, more specifically, a square shape in cross-section. In some aspects, as shown in FIG. 11 through 13, each of the frame members 255 can define a circular shape or, more generally, non-rectangular shape in cross-section. In some aspects, as shown, the frame members 255*a,b,c* can be joined by welding or by weldments. In some aspects, the frame members 255*a,b,c* can be joined with one or more fasteners (not shown). The frame 250 can define a polygonal shape when viewed along the axis 151. For example and without limitation, the frame 250 can define a triangular shape or, as shown, the shape of a quadrilateral when so viewed. The pivot portion 177 can be secured to one of the frame members 255 such as an intersection between the frame members 255*a,c*. The pivot portion 177 itself can define one or more openings 278, which can be sized and shaped to lockably receive and engage the torsion shaft 220. For example and without limitation, when the torsion shaft defines a square shape in cross-section the openings 278 can be square in shape The attachment portion 175, which can be configured to receive the cable 140, can be secured to one of the frame members 255 such as the frame member 255*b*. In some aspects, the attachment portion 175 can be secured to the frame 250 with one or more fasteners (not shown). In some aspects, the attachment portion 175 can be secured to the frame 250 by welding or by weldments. The attachment portion 175 can comprise or define an "eye" or closed loop.

The cable guide 180 can comprise one or more brackets 285, which can be secured to the frame 250. In some aspects, the one or more brackets 285 can be secured to the frame 250 with fasteners 289, which can include a bolt, washer, and/or nut. In some aspects, the one or more brackets 285 can be secured to the frame 250 by welding or by weldments. The roller 185 can be supported by a pivot fastener 287 and/or by the one or more brackets 285. More specifically, in some aspects, the roller 185 can be positioned between a pair of the brackets 285 and can be configured to rotate freely about an axis such as, for example and without limitation, an axis of the pivot fastener 287.

Figure 3A:
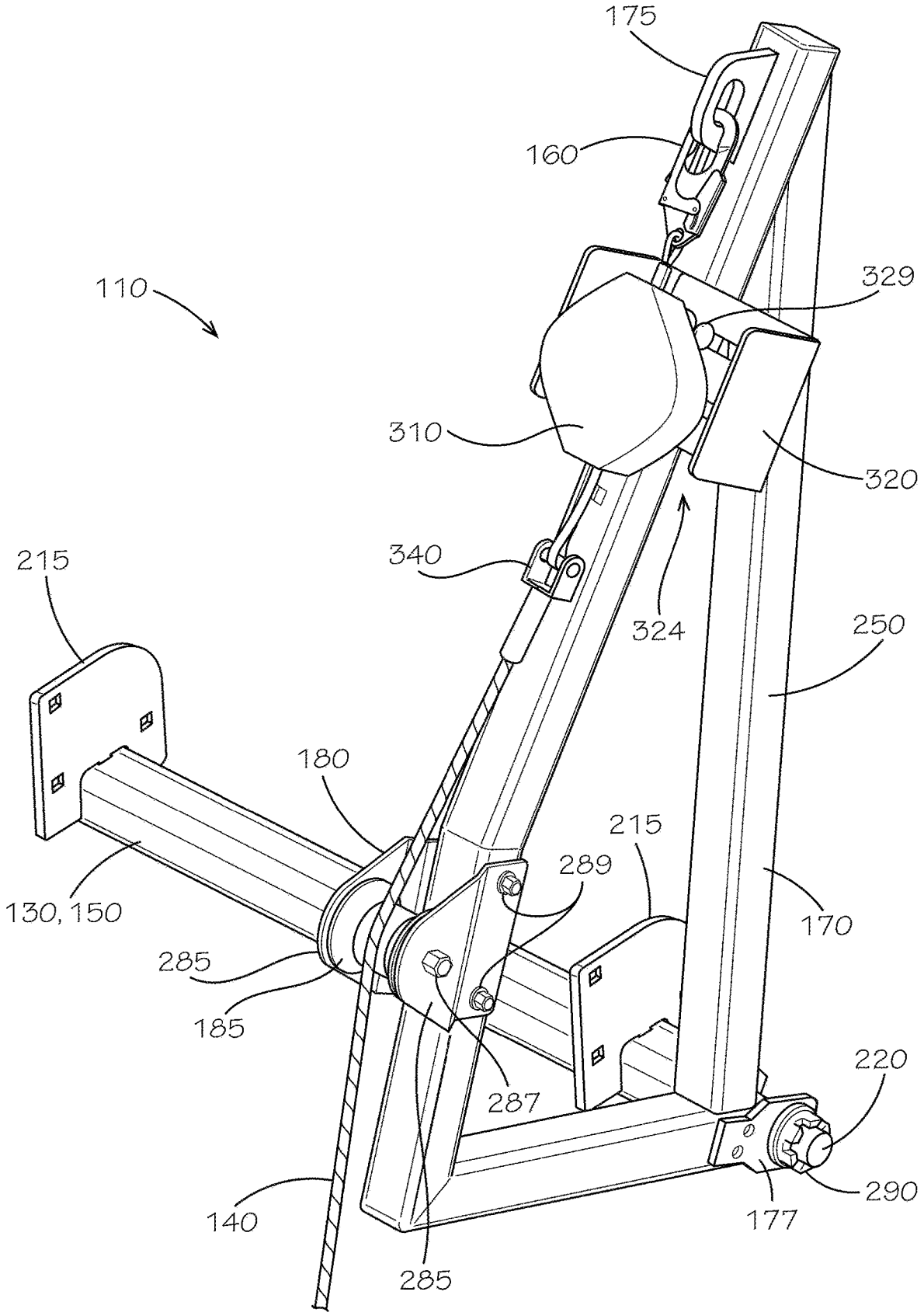
FIG. 3A is a front perspective view of the upper anchor and the cable of FIG. 1 showing also a self-retracting lifeline (SRL) and a guide bracket in accordance with another aspect of the current disclosure.

FIG. 3A is a front perspective view of the upper anchor 110 and the cable 140 of FIG. 1 in accordance with another aspect of the current disclosure. A cable attachment accessory 310 can be secured to the cable 140 via an adapter 340, which can itself be secured to the cable 140, and can be positioned between the cable guide 180 and the attachment portion 175. The cable attachment accessory 310 can be received at least partially within a notch 324 defined by a guide bracket 320, which can form a portion of the fall arrest arm 170. In some aspects, the guide bracket 320 can be secured to the frame 250 with fasteners 329, which can include a bolt, washer, and/or nut. In some aspects, the one or more brackets 285 can be secured to the frame 250 by welding or by weldments. The guide bracket 320, which can form a part of the fall arrest arm 170, can face towards a front thereof. In some aspects, the notch 324 can be configured to receive at least the cable 140. In some aspects, the notch 324 can be configured to receive at least the cable attachment accessory 310, which can be a self-retracting lifeline (SRL). The guide bracket 320 can keep the cable attachment accessory 310 from moving to left or to the right with respect to the fall arrest arm 170.

Figure 3B:
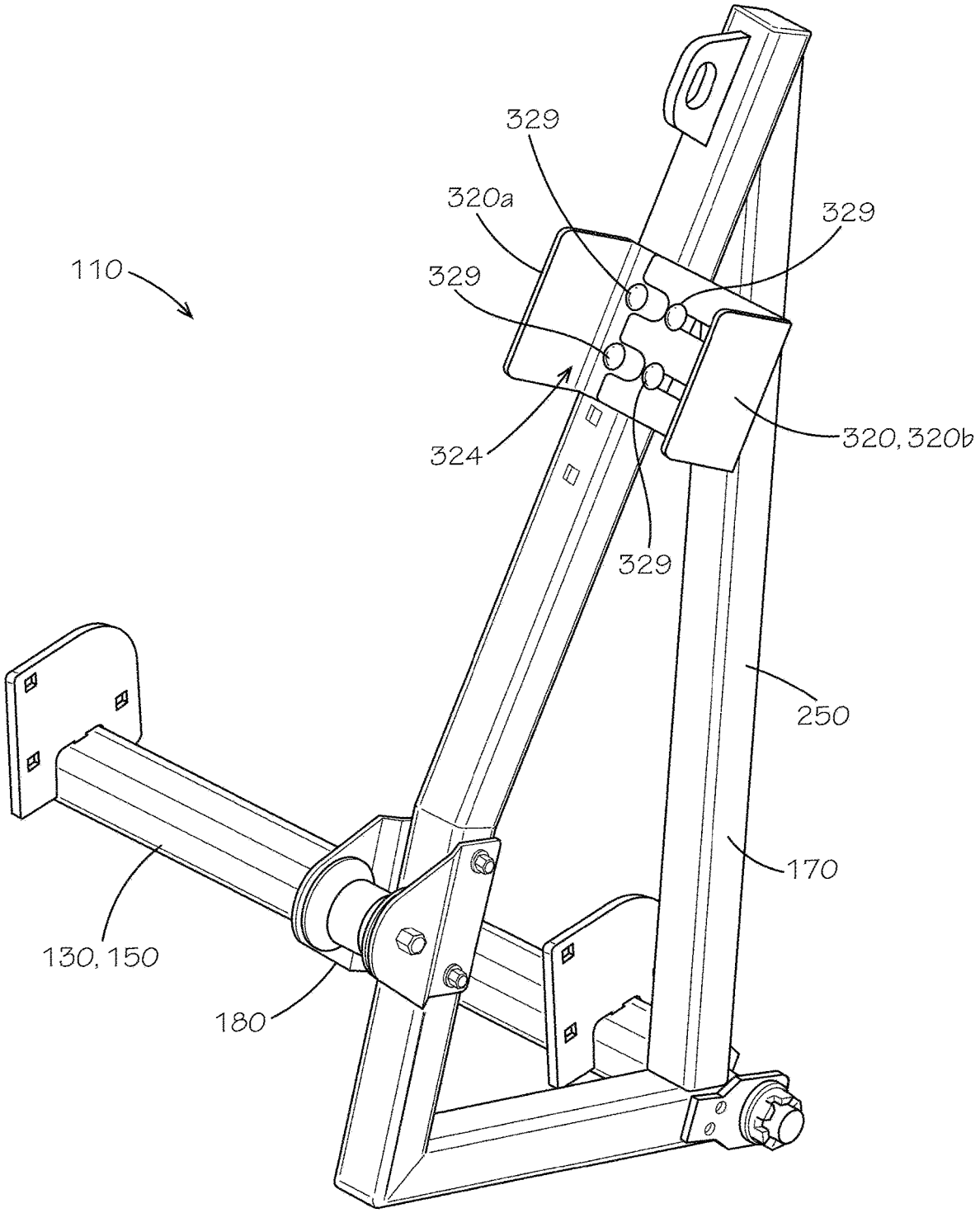
FIG. 3B is a front perspective view of the upper anchor of FIG. 4 with the cable and the SRL of FIG. 4 hidden for clarity.
Figure 4:
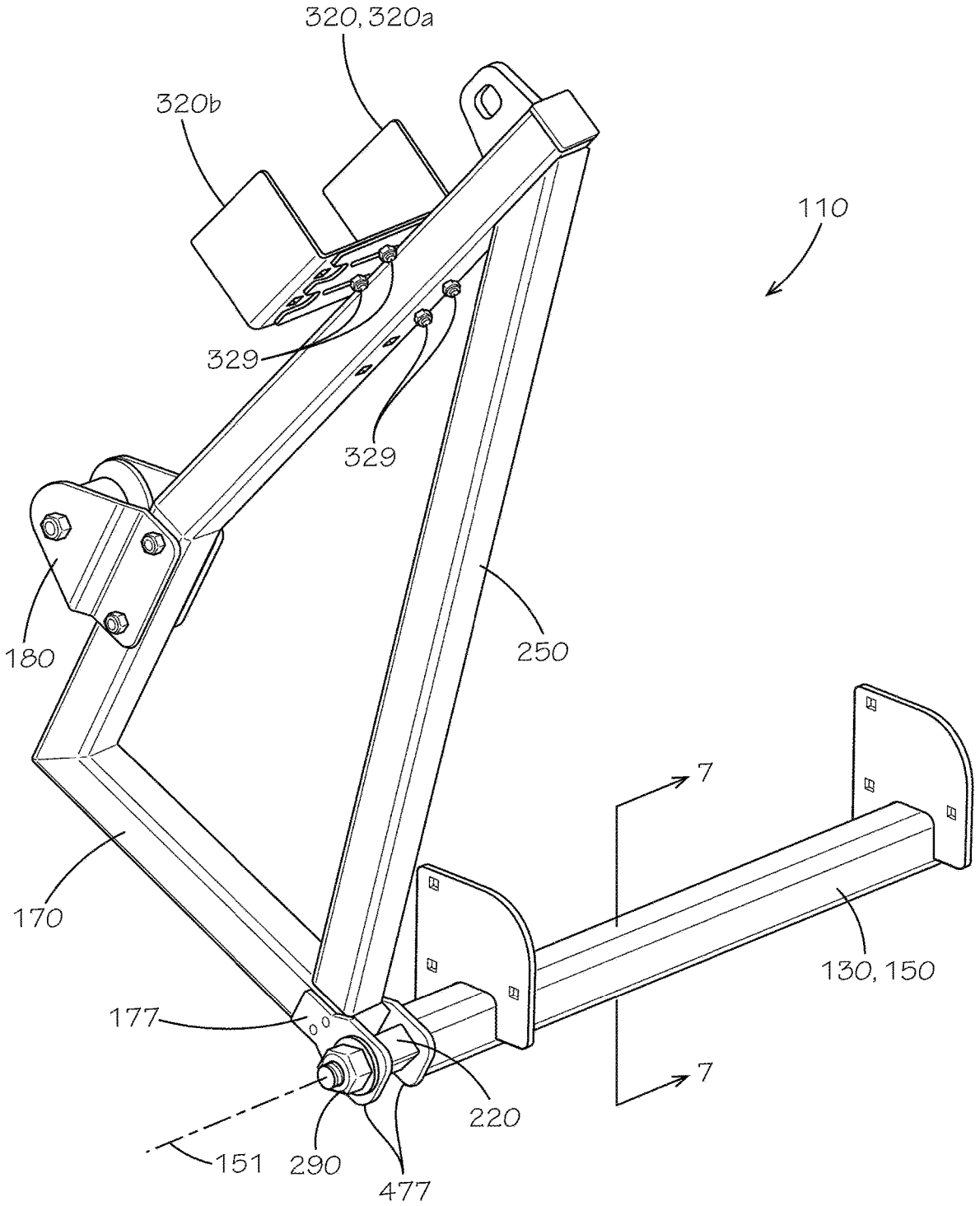
FIG. 4 is a rear perspective view of the upper anchor of FIGS. 3A and 3B.

FIG. 3B is a front perspective view of the upper anchor 110 of FIG. 4 with the cable 140 and the cable attachment accessory 310 of FIG. 4, e.g., the SRL, hidden for clarity. In some aspects, as shown, the guide bracket 320 can comprise a first portion 320*a* and a second portion 320*b*. More specifically, the second portion 320*b* can be slidably adjustable with respect to the first portion 320*a* and can adjust a notch width 524 (shown in FIG. 5) of the notch 324, which together with a direction of adjustment of the second portion 320*b* can be measured in a direction angled with respect to the cable 140 (shown in FIG. 3A) during use of the fall arrest device 100 (shown in FIG. 1A) and, more specifically, in a direction angled substantially at 90 degrees with respect to the cable 140. In some aspects, the guide bracket 320 can be formed as a monolithic component, i.e., a singular component that constitutes a single material without joints or seams.

FIG. 4 is a rear perspective view of the upper anchor 110 of FIG. 4. Again, the guide bracket 320 can be secured to the frame 250 with the fasteners 329. The second portion 320*b* of the guide bracket 320 can be secured to the first portion 320*a* of the guide bracket 320 with the fasteners 329. The torsion shaft 220 can extend through the openings 278 (shown in FIG. 2) of a pair of flanges or tabs 477 of the pivot portion 177 of the fall arrest arm 170. More specifically, a rotational position of the torsion shaft 220 about the axis 151 can be fixed with respect to a rotation position of the fall arrest arm 170.

Figure 5:
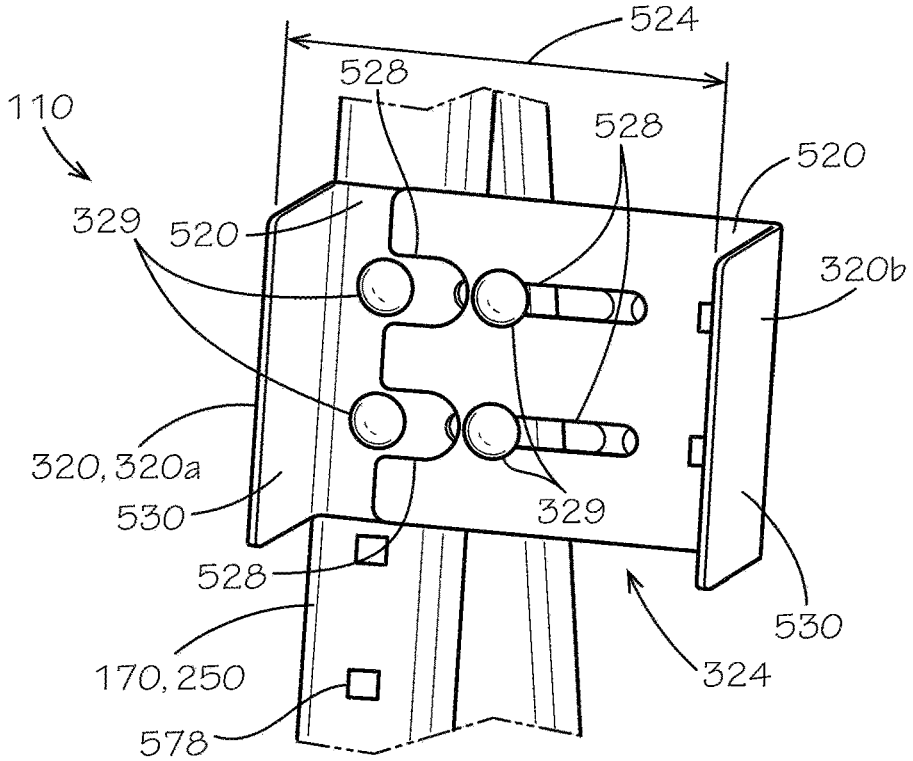
FIG. 5 is a detail front perspective view of the guide bracket of FIGS. 3A and 3B.
Figure 6:
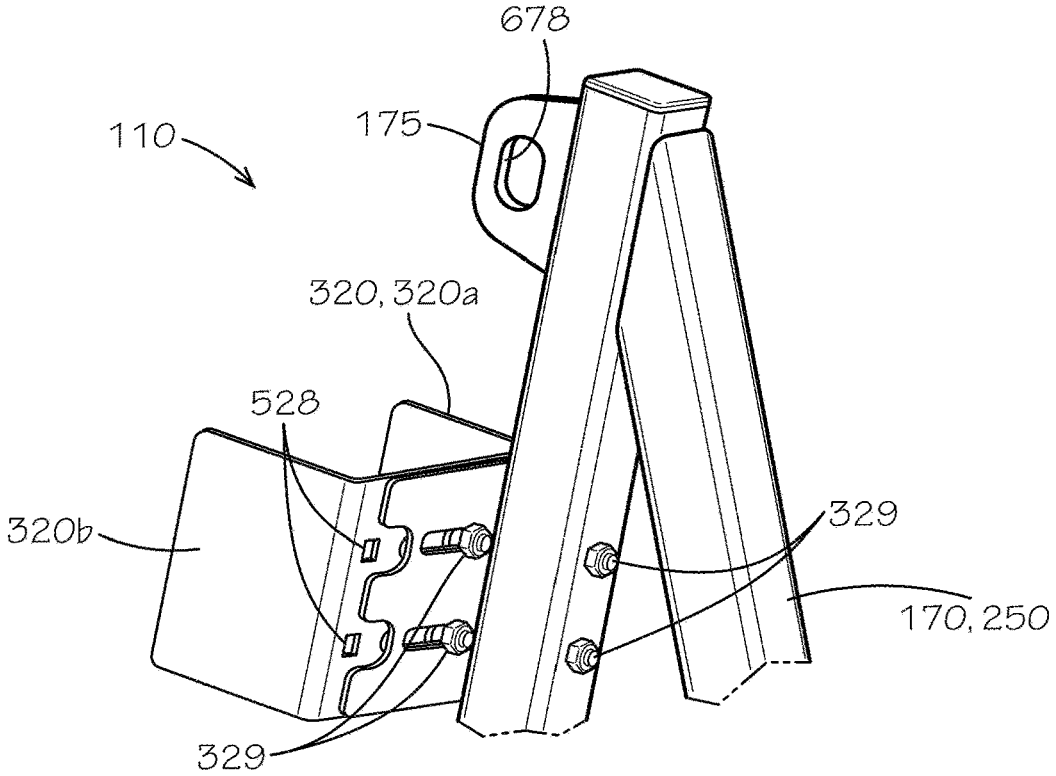
FIG. 6 is a detail rear perspective view of the guide bracket of FIGS. 3A and 3B.

FIGS. 5 and 6 are detail front and rear perspective views of the guide bracket 320 of FIGS. 3A and 3B. Each of the first portion 320*a* and the second portion 320*b* of the guide bracket 320 can comprise a base panel or main panel 520 and a wall panel or side panel 530, which can be angled with respect to the main panel 520. Each of the first portion 320*a* and the second portion 320*b* can define openings 528 for the fasteners 329. In some aspects, at least some of the openings 528 can be slotted holes or notches to facilitate adjustment of the notch width 524 of the notch 324. The frame 250 and, more generally, the fall arrest arm 170 can define openings 578 to receive one or more of the fasteners 329. The attachment portion 175 (shown in FIG. 6), meanwhile, can define an opening 678 (shown in FIG. 6), which can be configured to receive the cable 140 (shown in FIG. 1A) or an accessory to the cable 140 such as, for example and without limitation, the cable attachment 160 (shown in FIG. 1A). In some aspects, at least some of the openings 528 can be square or circular holes. As shown, the first portion 320*a* and the second portion 320*b* of the guide bracket 320 can define identical geometry.

Figure 7A:
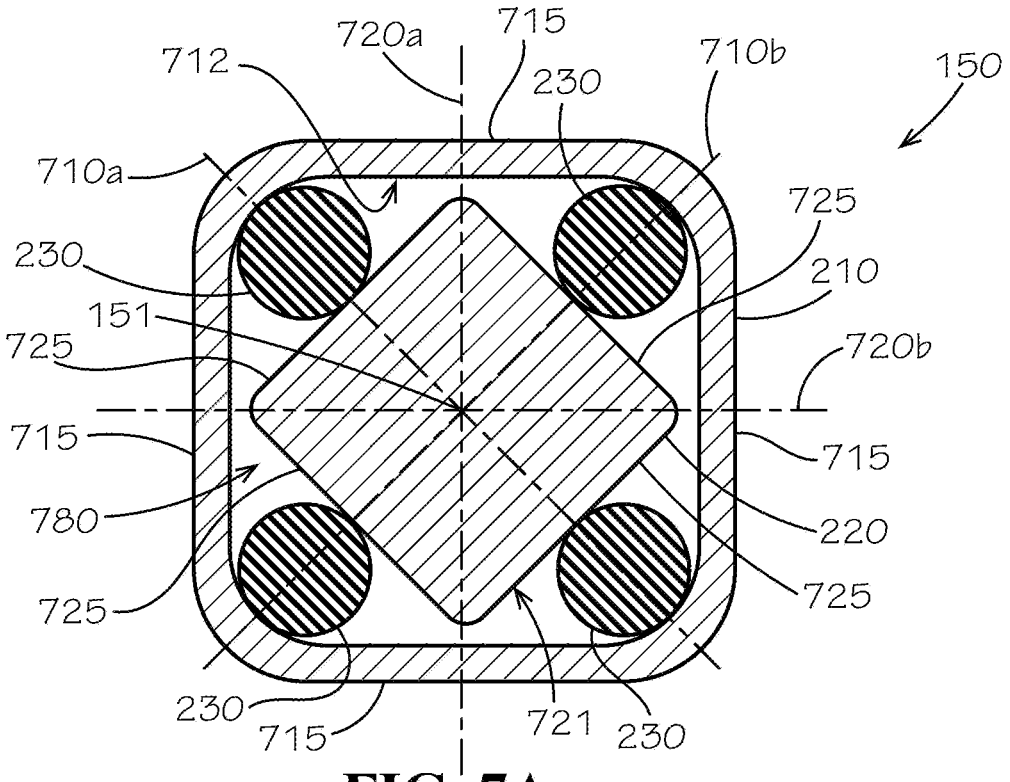
FIG. 7A is a sectional view of the torsion biasing element of the upper anchor of FIG. 4 with the torsion biasing element in an unloaded or unbiased condition and taken along 7-7 of FIG. 4.

FIG. 7A is a sectional view of the torsion biasing element 150 of the upper anchor 110 (shown in FIG. 4) of FIG. 4 with the torsion biasing element 150 in an unloaded or unbiased condition and taken along 7-7 of FIG. 4. Again, the torsion shaft 220 can be received within the housing 210 of the torsion biasing element 150; and, more specifically, each of the cords 230 can be positioned inside a cavity 780 defined between the torsion shaft 220 and the housing 210. A cross-section of at least one of the housing 210 and the torsion shaft 220 can define a polygon with at least three sides 715. In some aspects, the torsion shaft 220, which can be centered about and can define the axis 151, can define reference lines 720*a,b*. The reference lines 720*a,b* can be bisectors and, more specifically, diagonal bisectors of the torsion shaft 220. In the unloaded or unbiased condition of the torsion biasing element 150, the reference lines 720*a,b* can bisect or, more generally, be rotationally offset from diagonals 710*a,b*, respectively, of the housing 210, which can be bisectors and, more specifically, diagonal bisectors of the housing 210.

Each of the cords 230 can be positioned adjacent to and in contact with an outer surface 721 of the torsion shaft 220. More specifically, each of the cords 230 can be positioned adjacent to and in contact with a side 725 of the torsion shaft 220. Each of the cords 230 can be positioned adjacent to and in contact with an inner surface 712 of the housing 210. More specifically, each of the cords 230 can be positioned adjacent to and in contact with a side 715 of the housing 210 and/or, as shown, an intersection of adjacent sides 715. In some aspects, as shown, each of four of the cords 230 can be positioned inside the cavity 780 defined between the torsion shaft 220 and the housing 210. In some aspects, one or more of the cords 230 can be in an undeformed condition when positioned or disposed inside the cavity 780 between the housing 210 and the torsion shaft 220. In some aspects, one or more of the cords 230 can be in a deformed condition, i.e., compressed, when positioned inside the cavity 780 between the housing 210 and the torsion shaft 220.

In some aspects, a temperature of the cords 230 can be significantly reduced (sufficient to cause shrinkage of the cords 230) before assembly of the torsion biasing element 150 to facilitate such assembly. More specifically, in some aspects, a temperature of one or more of the cords 230 can be reduced to a temperature sufficient to freeze a material forming the cords such as, for example and without limitation, −20° Fahrenheit (approximately −29° Celsius) for rubber. After the torsion biasing element 150 reaches a temperature equilibrium, the cords 230 can expand to fit more tightly inside the cavity 780. In some aspects, one or more of the cords 230 can be compressed in order to fit within the cavity 780 and can be mechanically pushed or pressed into the cavity 780 in a longitudinal direction of the torsion biasing element 150.

Figure 7B:
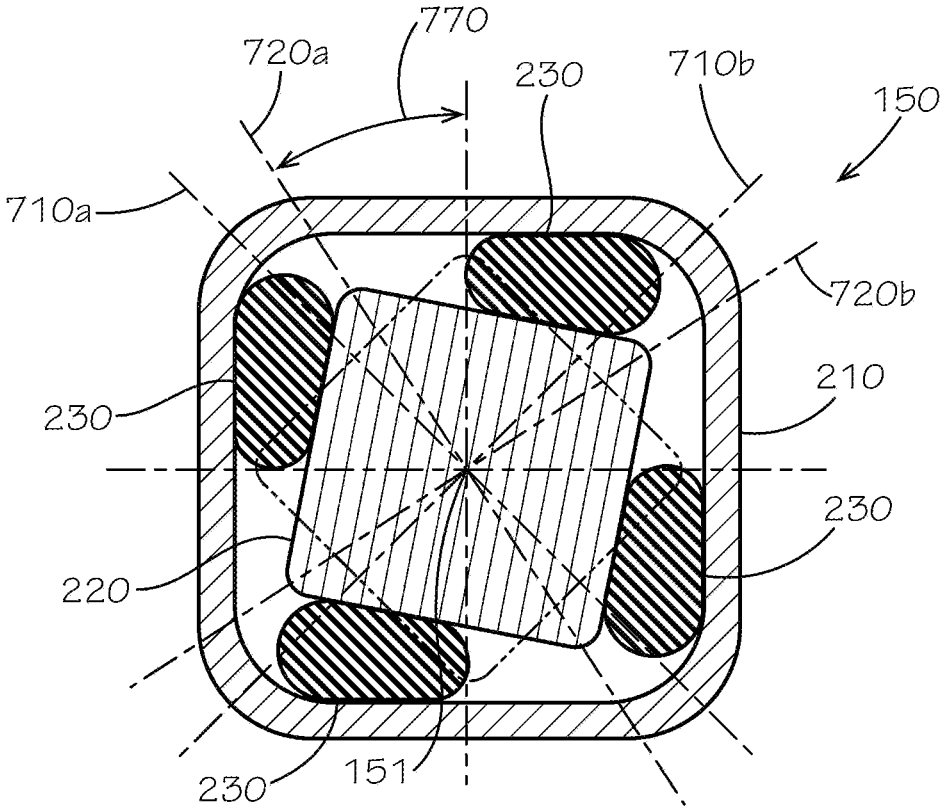
FIG. 7B is a sectional view of the torsion biasing element of FIG. 5A similarly as taken along 7-7 of FIG. 4 but in a loaded or biased condition.

FIG. 7B is a sectional view of the torsion biasing element 150 of FIG. 7A similarly as taken along 7-7 of FIG. 4 but in a loaded or biased condition. Rotation of the torsion shaft 220 in a counterclockwise direction as shown can cause result in an angle 770 between an original orientation of the reference line 720*a* and a new orientation of the reference line 720*a*, which can be equal to a rotational movement of the torsion shaft 220. In some aspects, the angle 770 can measure at least 30 degrees. In some aspects, the angle 770 can measure 50 degrees. In some aspects, the angle 770 can measure 60 degrees. In the loaded or biased condition, each of the cords 230 can deform or compress like a compression spring such that the cords 230 will store potential energy tending to biasing the torsion shaft 220 in a rotational direction back towards the unloaded or unbiased condition when the potential energy will be expended in such movement to the unloaded or unbiased condition. As shown, each of the cords 230 can become more flattened in the loaded or biased condition and can return to an original shape, which can be circular, in the unloaded or unbiased condition. In some aspects, the original shape of the cords 230 can be non-circular.

Figure 7C:
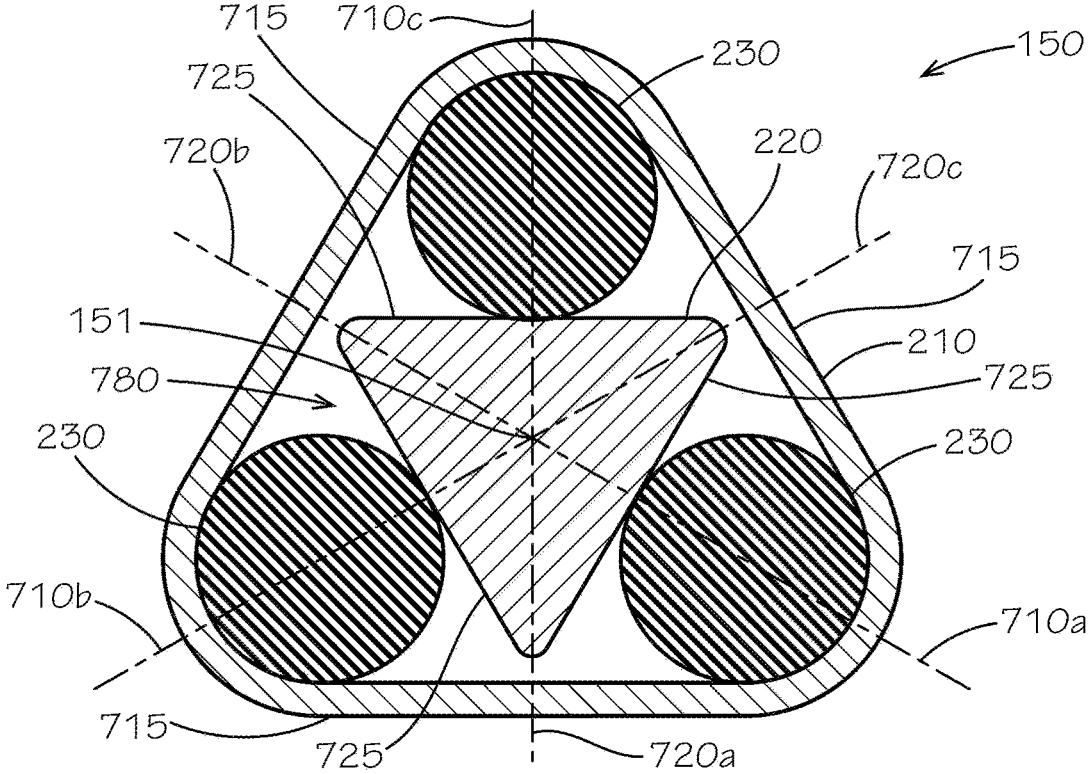
FIG. 7C is a sectional view of the torsion biasing element of the upper anchor of FIG. 4 with the torsion biasing element in an unloaded or unbiased condition and taken along 7-7 of FIG. 4 in accordance with another aspect of the current disclosure.

FIG. 7C is a sectional view of the torsion biasing element 150 of the upper anchor 110 of FIG. 4 with the torsion biasing element 150 in an unloaded or unbiased condition and taken along 7-7 of FIG. 4 in accordance with another aspect of the current disclosure. In some aspects, as shown, each of three of the cords 230 can be positioned inside the cavity 780 defined between the torsion shaft 220 and the housing 210. More generally, a total quantity of the cords 230 can equal a total number of the sides 715 and a total number of the sides 725. In some aspects, the torsion shaft 220 can define not only the reference lines 720*a,b* but additional reference lines such as the reference line 720*c*. The reference lines 720*a,b,c* can be bisectors of a triangular or other shape of the torsion shaft 220. In the unloaded or unbiased condition of the torsion biasing element 150, the reference lines 720*a,b,c* can rotationally offset from diagonals 710*a,b,c*, respectively, of the housing 210, which can be bisectors of the housing 210. In some aspects, each of the sides 715 and the sides 725 can be straight, i.e., not curved, in cross-section. In some aspects, each of the respective sides 715 and the sides 725 can be straight in cross-section between or distal from where adjacent sides 715 intersect and where adjacent sides 725 intersect and can be curved in cross-section where adjacent sides 715 intersect and where adjacent sides 725 intersect.

Figure 7D:
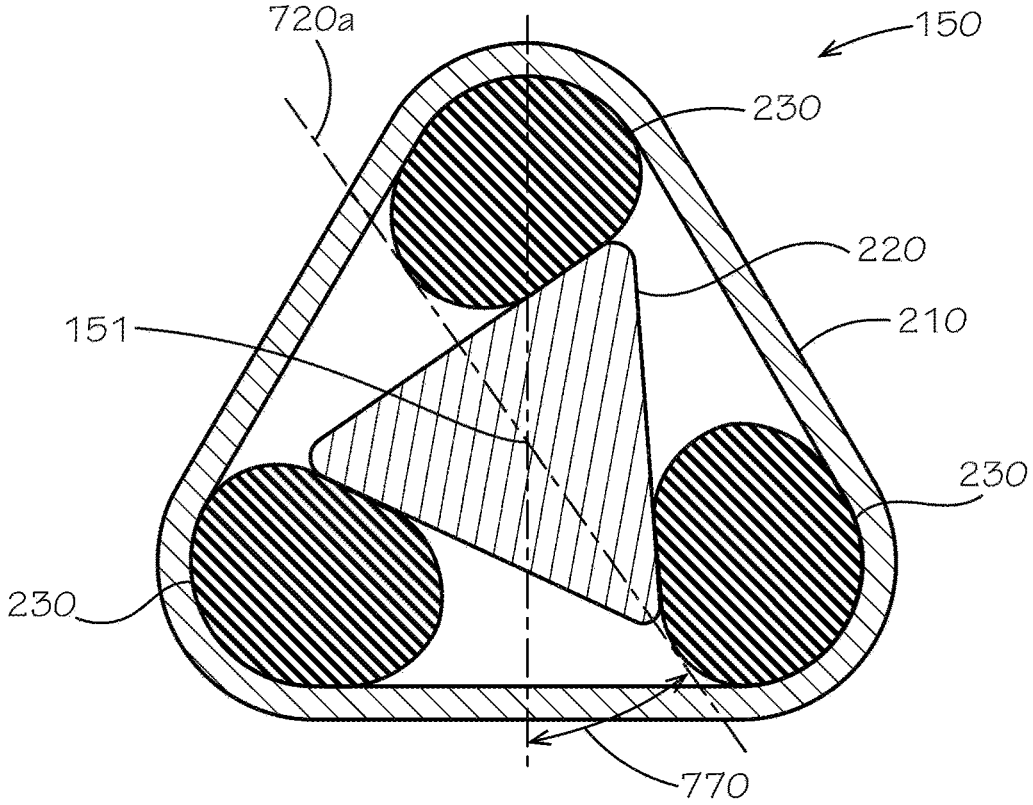
FIG. 7D is a sectional view of the torsion biasing element of FIG. 5C similarly as taken along 7-7 of FIG. 4 but in a loaded or biased condition.

FIG. 7D is a sectional view of the torsion biasing element 150 of FIG. 7C similarly as taken along 7-7 of FIG. 4 but in a loaded or biased condition. Again, although the geometry can vary as shown in FIGS. 7A and 7B or even FIGS. 7C and 7D, rotation of the torsion shaft 220 in a counterclockwise direction as shown can cause result in the angle 770 between the original orientation of the reference line 720*a* and the new orientation of the reference line 720*a*, which can again be equal to a rotational movement of the torsion shaft 220.

Figure 8:
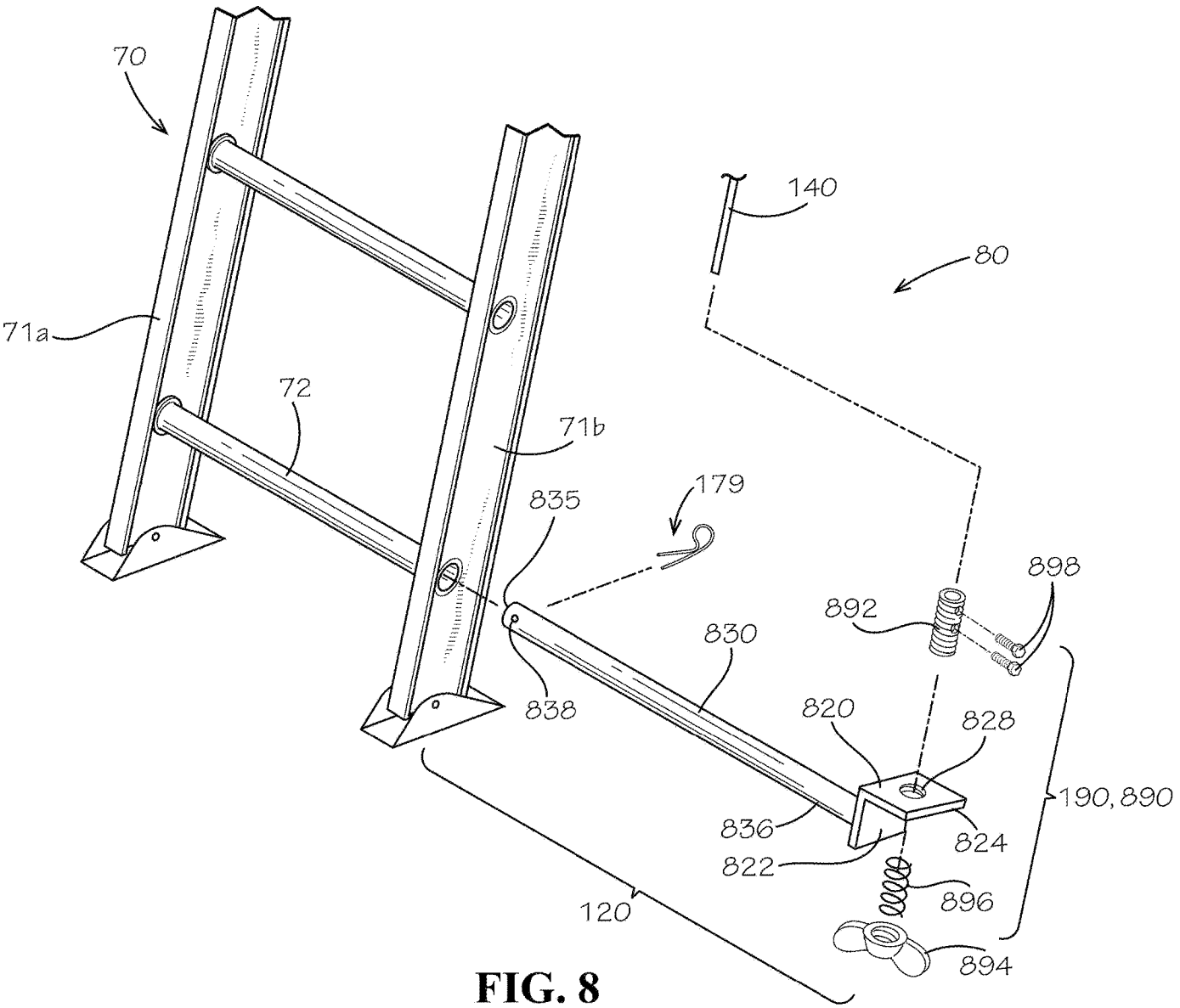
FIG. 8 is an exploded front perspective view of the lower anchor and the ladder of FIG. 1 taken from detail 8 of FIG. 1.

FIG. 8 is an exploded front perspective view of the lower anchor 120 and the ladder 70 of FIG. 1 taken from detail 8 of FIG. 1A. The cable 140 of the fall arrest system 80 can be secured to the lower anchor 120 with the cable attachment 190. The lower anchor 120 can comprise a body 820, to which the cable attachment 190 can be secured. In some aspects, the body 820 can be an anchor bracket. The body 820 can define a cable attachment end proximate to the cable 140 and a distal end proximate to the ladder 70.

In some aspects, the lower anchor 120 can comprise a ladder fastener 830, which can be configured to secure the body 820 of the lower anchor 120 to the ladder 70. In some aspects, the ladder fastener 830 can comprise an anchor rod and can be configured to extend through the rung 72 of the ladder 70, which can be hollow. The ladder fastener 830, can be secured to the body 820 and can extend through the ladder rung 72 of the ladder 70 and can be secured to or retained on the ladder 70 with the mounting fastener 179. More specifically, in some aspects, the ladder fastener 830 can be secured to the body 820 with welding or weldments. In some aspects, the ladder fastener 830 can be secured to the body 820 with one or more fasteners. In some aspects, a length of the ladder fastener 830 can be greater than a length of the ladder rung 72 to facilitate secure retention of the ladder fastener 830 on both sides of the ladder 70—for example and without limitation, on one side with the body 820 and on the other side with the mounting fastener 179. The mounting fastener 179 can be any fastener configured to maintain a position of the ladder fastener 830 with respect to the ladder rung 72 such as, for example and without limitation, a cotter pin. A bore 838 can be defined in the ladder fastener 830 proximate to a first end 835 of the ladder fastener 830 and can be sized to receive the mounting fastener 179. The body 820 can be secured to a second end 836 of the ladder fastener 830, the second end 836 being distal from the first end 835.

The body 820 itself can comprise a ladder mounting portion 822 and a cable attachment portion 824. In some aspects, as shown, the ladder fastener 830 can be secured to the ladder mounting portion 822, including in the ways described above. The cable 140 can be attached to the cable attachment portion 824. More specifically, a portion of the body 820 such as the cable attachment portion 824 can define a bore 828, which can be sized and otherwise configured to receive and/or engage a first portion 892 of the cable attachment 190. In some aspects, as shown, the body 820 can define an L-shape and, more specifically, a surface of the cable attachment portion 824 can be angled with respect to a surface of the ladder mounting portion 822. In some aspects, as shown, the body 820 can be formed from a single flat blank of raw material.

The cable attachment 190, which can secure a lower end of the cable 140 to the lower anchor 120, can comprise a cable fastener 890. More specifically, the cable fastener 890 can comprise the first portion 892, which can be a threaded adapter for defining threads in or at the lower end of the cable 140. More specifically, the first portion 892 can defined a bore sized to receive the cable 140 and can be secured to the cable 140 with locking fasteners 898 or through crimping some or all of the first portion tightly against the cable 140. The cable fastener 890 can comprise a second portion 894, which can be a nut (e.g., a wing nut as shown) or other female threaded fastener and can be configured to threadably and selectively engage the first portion 892. The cable fastener 890 can comprise a third portion 896, which can be a compression spring and can be configured to reduce or remove slack or even incorporate tension in the connection between the first portion 892 and the second portion 894. In some aspects, a specific shape or proportions of the body 820 can be adjusted to facilitate adjustment (e.g., rotation) of the third portion 896 without interference with the body 820.

Figure 9:
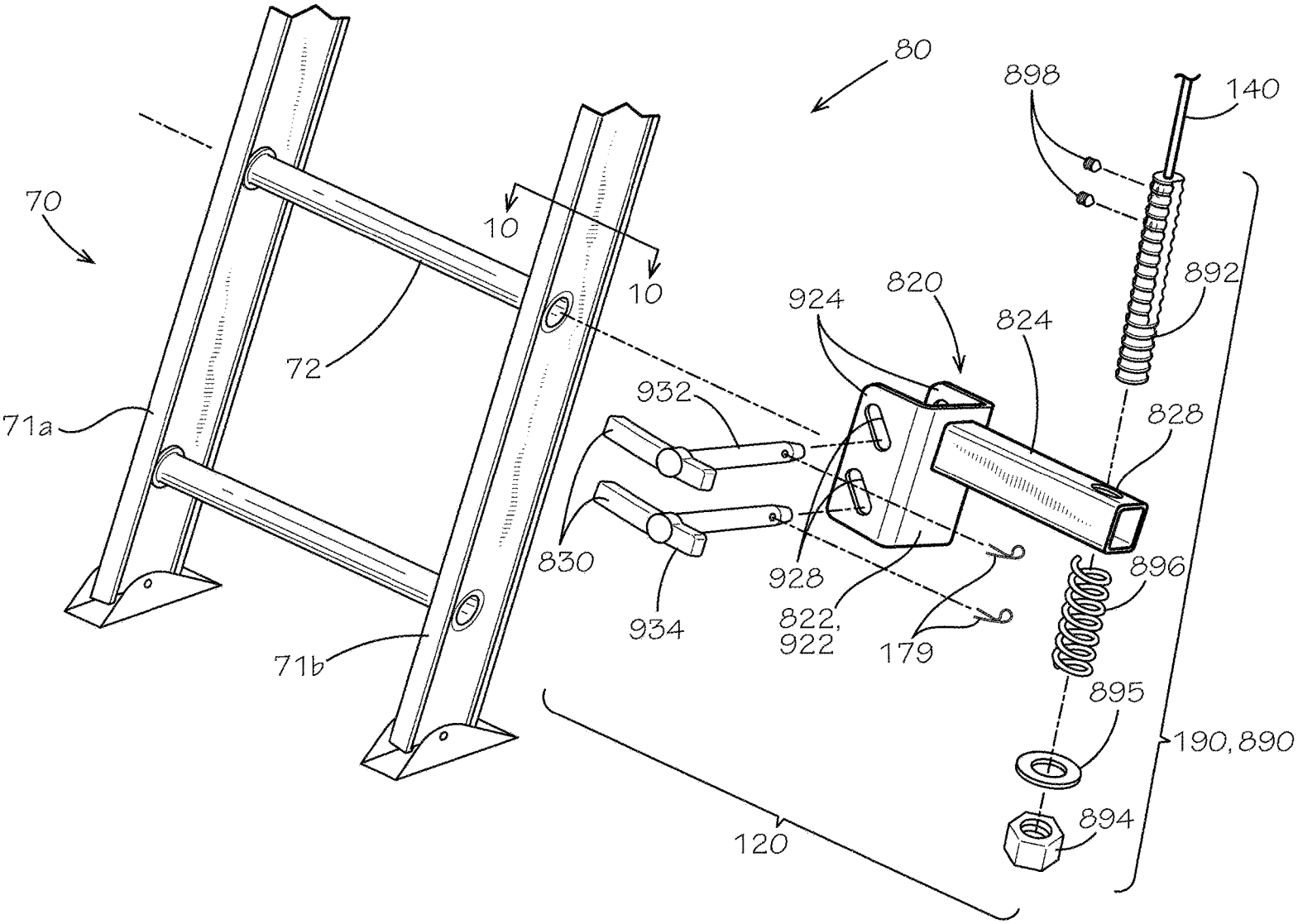
FIG. 9 is an exploded front perspective view of the lower anchor and the ladder of FIG. 1 similarly as taken from detail 8 of FIG. 1 in accordance with another aspect of the current disclosure.

FIG. 9 is an exploded front perspective view of the lower anchor 120 and the ladder 70 of FIG. 1 similarly as taken from detail 8 of FIG. 1 in accordance with another aspect of the current disclosure. In some aspects, as shown, the body 820 of the lower anchor 120 can wrap around one of the rails 71*a,b* of the ladder 70 during assembly thereto. More specifically, as shown, the body 820 can extend past the rail 71*b* and one or more ladder fasteners 830 can engage opposite sides of the body 820 at the ladder rung 72 and thereby engage the ladder 70. Again, the mounting fasteners 179 can engage the ladder fasteners 830 and thereby lockably engage the body 820 and the ladder fasteners 830 to the ladder 70. One ladder fastener 830 can engage the body 820 at a position above the ladder rung 72, and another ladder fastener 830 can engage the body 820 at a position below the ladder rung 72. Movement of the body 820 and, more generally, the lower anchor 120 can thus be restricted in three dimensions. More specifically, the ladder fasteners 830 can comprise a shaft 932 and a handle 934, which can be a T-handle. In some aspects, the mounting fastener 179 can be incorporated into the ladder fastener 830 such as with, for example and without limitation, a quick-release pin with a spring-loaded retaining ball.

Again, the body 820 can comprise the ladder mounting portion 822 and the cable attachment portion 824. More specifically, as shown, the ladder mounting portion 822 can comprise a base panel or main panel 922 and one or more wall panels or side panels 924. Openings 928 in the side panels 924 can receive the ladder fasteners 830. The openings 928 can be slotted openings to facilitate assembly of the body 820 and, more generally, the lower anchor 120 to the ladder 70 even when the rail 71*a,b* is larger or smaller. More specifically, the lower anchor 120 can accommodate different sizes of the rails 71*a,b*. In some aspects, as shown, the cable attachment portion 824 can be a rigid tube such as, for example and without limitation, a hollow square tube. The cable attachment portion 824 can be secured to the ladder mounting portion 822 with a fastener or, as shown, with welding or a weldment. The cable attachment 190, which can secure the lower end of the cable 140 to the lower anchor 120, can comprise the cable fastener 890, but as shown the locking fasteners 898 can be set screws. Between the second portion 894 and the third portion 896, a fourth portion 895 can be positioned. The fourth portion 895 can be a washer.

Figure 10:
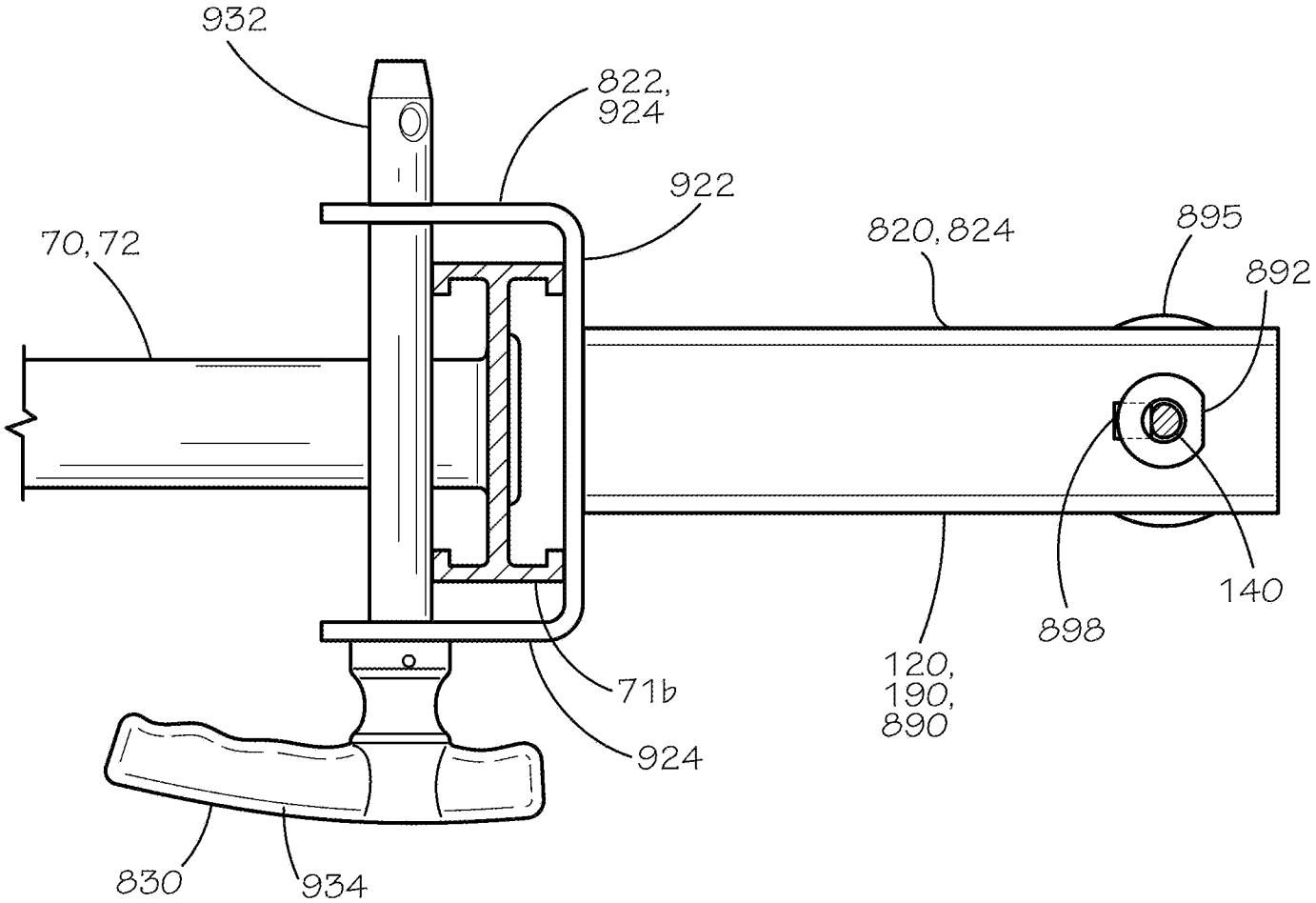
FIG. 10 is a sectional view of the lower anchor and the ladder of FIG. 9 taken from line 10-10 of FIG. 9.

FIG. 10 is a sectional view of the lower anchor 120 and the ladder 70 of FIG. 9 taken from line 10-10 of FIG. 9. As shown, the main panel 922 can be sized to extend at least to a front to a back of either of the rails 71*a,b* (rail 71*a* shown in FIG. 9) of the ladder 70. The side panels 924 can extend inward across the rail 71*a,b* to which the body 820 is engaged. In some aspects, as shown, the lower anchor 120 need not extend through the ladder rung 72.

FIG. 11 is a top plan view of the fall arrest system 80 of FIG. 1 comprising the fall arrest device 100, which again can comprise the upper anchor 110 in accordance with another aspect of the current disclosure. The upper anchor 110 is shown in the unloaded position, and the ladder 70 (shown in FIG. 1A) is hidden for clarity. In some aspects, as shown, the fall arrest arm 170 can be positioned between the guide rails 2020*a,b*. In some aspects, as also shown, one and only one frame member 255 of the fall arrest arm 170 can extend from the torsion biasing element 150 to the attachment portion 175. More specifically, in some aspects, the frame member 255 can define the circular shape shown.

As also shown, the cable guide 180 can be positioned between the guide rails 2020*a,b*. In some aspects, the cable guide 180 can be offset from the centerline 601 (shown in FIG. 18) of the ladder dock 90 to facilitate passage of the user across the ladder dock 90 and between the handles 2020*a,b*. More specifically, the cable guide 180 can be secured to the ladder dock 90 and, more specifically, the connecting panel 20 thereof. The cable guide 180 can comprise a main panel 1180, which can be secured to the ladder dock 90 with mounting fasteners 1190. The one or more brackets 285 can extend from the main panel 1180.

FIG. 12 is a side view of the fall arrest system 80 and the fall arrest device 100 of FIG. 11. The upper anchor 110 and, more specifically, the fall arrest arm 170 are shown in both an unloaded position (the geometry in solid lines) and a loaded position (the geometry in phantom or broken lines). The ladder 70 (shown in FIG. 1A) is, again. hidden for clarity. In some aspects, an angle or range of movement 1207 of the fall arrest arm 170 against the biasing of the torsion biasing element 150 and between the loaded position and the unloaded position can be less than 30 degrees, 30 degrees, or at least 30 degrees. In some aspects, the angle 1207 can be less than 50 degrees, 50 degrees, or at least 50 degrees. In some aspects, the angle 1207 can be less than 60 degrees, 60 degrees, or at least 60 degrees. In some aspects, as shown, the frame member 255 of the fall arrest arm 170 or an axis 1201 thereof can be straight between its intersection with the torsion biasing element 150 (shown in FIG. 11) and the attachment portion 175. In some aspects, as shown, the fall arrest arm 170 can comprise a single, monolithic frame member 255 extending from the torsion biasing element 150 to the attachment portion 175. By being "monolithic," the frame member 255 can be formed as a singular component that constitutes a single material without joints or seams. In some cases, as shown, the cable 140 can detach, i.e., separate from and no longer remain contact with, the cable guide 180 when the upper anchor 110 and the fall arrest arm 170 are in the loaded position.

In some aspects, the fall arrest arm 170 can move to any position between the unloaded position and a fully loaded position depending on the load acting on the fall arrest arm 170, including and primarily through the cable 140. In some aspects, properties of the cords 230 (shown in FIG. 2) such as, for example and without limitation, the compressibility and the relative sizes and positions of the housing 210 (shown in FIG. 2), the torsion shaft 220 (shown in FIG. 2), and the cords 230 can determine the angle 1207 and/or reference end points or lines defining same such as, for example and without limitation, an axis 1201 or axes 1201*a,b* (shown in FIG. 13). In some aspects, one or more stops (not shown), which can be mechanical stops, can determine the angle 1207 and/or the reference end points or lines defining same. The angle 1207 can generally match or equal the angle 770 (shown in FIG. 7B) of the torsion biasing element 150.

As shown, a support arm 2030 can help stabilize a portion of the fall arrest system 80 such as the fall arrest device 100 and/or the ladder dock 90. More specifically, the support arm 2030 can contact and can be secured to a side surface 59 of a wall of the elevated structure 50, which can be a parapet as shown, with a mounting bracket 2038*b*. The support arm 2030 can contact and can be secured to the ladder dock 90 with a mounting bracket 2038*a*. The support arm 2030 can comprise a first extension member 2232 and, optionally, a second extension member 2234 received within, as shown, or about the first extension member 2232. Fasteners (not shown) can extend through holes 2238 defined in the first extension member 2232 and holes (not shown) in the second extension member 2234 for locking an extension setting or length of the support arm 2030. As shown, the mounting brackets 2038*a,b* can be hingedly mounted to the support arm 2030. More specifically, the mounting brackets 2038*a,b* can be hingedly mounted to the first extension member 2232 and the second extension member 2234, respectively. The mounting bracket 2038*a* can be mounted to either or both of the mounting panel 10 of the ladder dock 90 and the torsion biasing element 150 of the base 950 of the fall arrest device 100. In some aspects, as shown, the support arm 2030 can be used together with the bracket 1210, which can define mounting openings therein for attachment to the ladder dock 90.

FIG. 13 is a side view of the fall arrest system 80 and the fall arrest device 100 of FIG. 11 in accordance with another aspect of the current disclosure. The upper anchor 110 and, more specifically, the fall arrest arm 170 can again be in the unloaded and loaded positions (the geometry shown in solid lines and broken lines, respectively), and the ladder 70 is, again, hidden for clarity. In some aspects, as shown, the frame member 255 of the fall arrest arm 170 and the axis 1201 thereof can be curved between its intersection with the torsion biasing element 150 (shown in FIG. 11) and the attachment portion 175. More specifically, the axis 1201 can define at least two axis portions or axes 1201*a,b*, and the portion 1201*b* can be angled with respect to the portion 1201*a* by an angle 1307 shown. In some cases, as shown, the cable 140 can remain in contact with the cable guide 180 even when the upper anchor 110 and the fall arrest arm 170 are in the loaded position. More specifically, in some aspects, the curved shape of the frame member 255 or, at least when the axis 1201 of the frame member 255 is straight, a shortening of the frame member 255 can facilitate continued contact of the cable 140 with the cable guide 180.

Figure 14A:
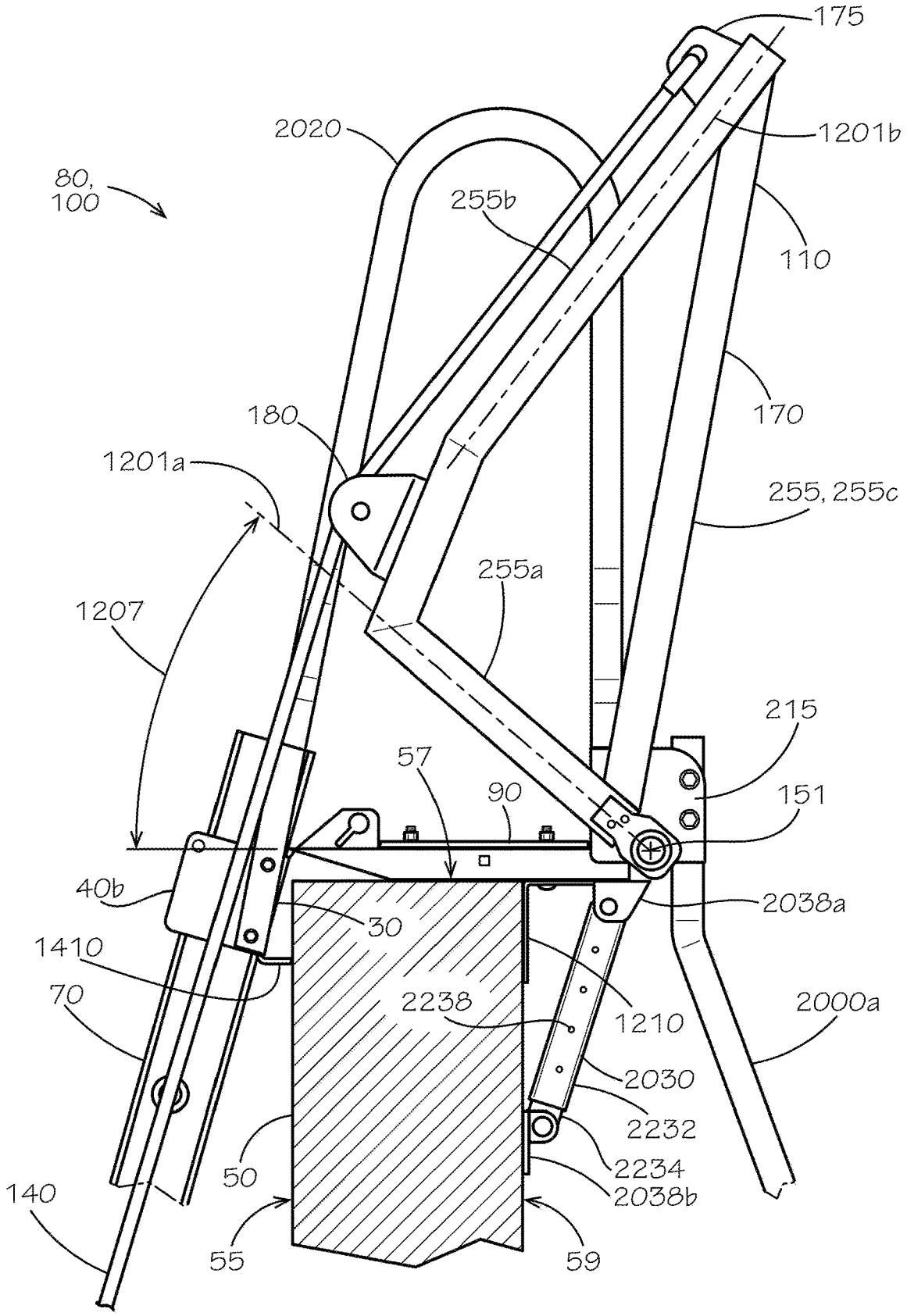
FIG. 14A is a side view of the fall arrest system and the fall arrest device of FIG. 1A in accordance with another aspect of the current disclosure, with the upper anchor shown in the unloaded position and also showing the ladder of FIG. 1 and a parapet descent apparatus in an installed condition on a roof with a parapet.

FIG. 14A is a side view of the fall arrest system 80 and the fall arrest device 100 of FIG. 11 in accordance with another aspect of the current disclosure. The upper anchor 110 and, more specifically, the fall arrest arm 170 are shown in an unloaded position. Again, the fall arrest system 80 can comprise the ladder 70. The fall arrest system 80 can comprise a parapet descent apparatus 2000*a*, which is shown in an installed condition on a roof, i.e., the elevated structure 50, with a parapet. More specifically, the parapet descent apparatus 2000*a* can be secured to the ladder dock 90, the fall arrest device 100, or another portion of the fall arrest system 80. The axis 1201*a* used for measurement of the angle 1207 can be defined by the frame member 255*a*. Similarly, each of the portions of the frame member 255 can define respective axes, which in some cases can extend through the axis 151 and in some aspects need not extend through the axis 151.

A stop panel 1410 can extend from any of the aforementioned panels of the ladder dock 90 to help, for example, maintain a proper orientation of the ladder dock 90 with respect to the elevated structure 50. More specifically, as shown, the stop panel 1410 can extend from the ladder rest panel 30. The stop panel 1410 can be angled with respect to another panel of the ladder dock 90 such as, for example and without limitation, the mounting panel 10. The stop panel 1410 can be configured to contact a surface of the elevated structure 50 that is angled with respect to the horizontal surface, e.g., the surface 55, and thereby prevent one of rotation and translation of the ladder dock 90 with respect to the elevated structure 50.

Figure 14B:
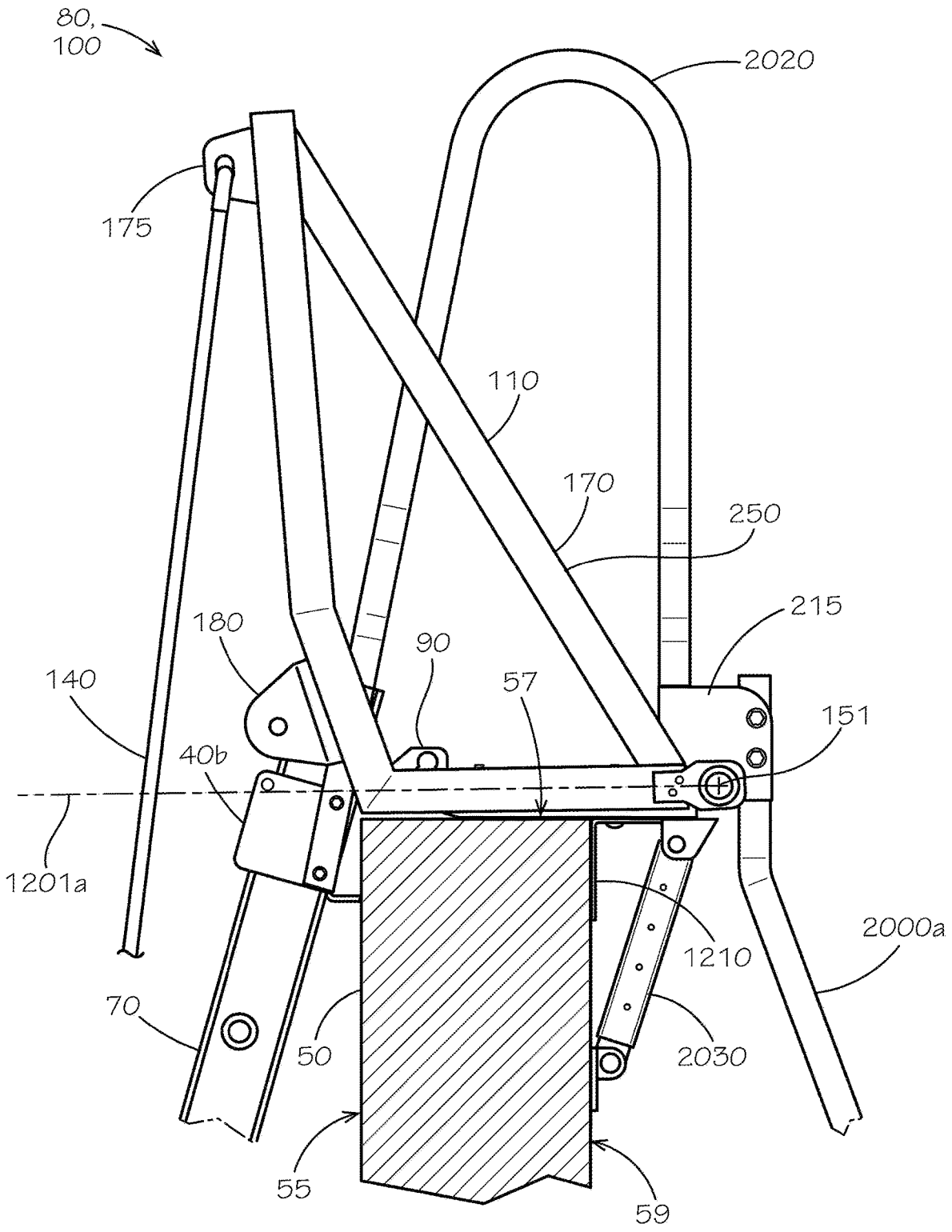
FIG. 14B is a side view of the fall arrest system and the fall arrest device of FIG. 14A with the upper anchor shown in the loaded position and again showing the ladder of FIG. 1 and the parapet descent apparatus of FIG. 14A.

FIG. 14B is a side view of the fall arrest system 80 and the fall arrest device 100 of FIG. 14A showing, again, the ladder 70 of FIG. 1 and the parapet descent apparatus 2000*a* of FIG. 14A. The upper anchor 110 and, more specifically, the fall arrest arm 170 are shown in the loaded position. In some aspects, the frame 250 can contact the elevated structure 50 to prevent further movement of the fall arrest arm 170. In some aspects, a bumper or other appendage (not shown) to the frame 250 can contact the elevated structure 50 to prevent further movement of the fall arrest arm 170. The appendage can comprise a resilient material, which can further decelerate the fall arrest arm 170—in addition to deceleration provided by operation of the torsion biasing element 150. As shown, the surrounding portions of the fall arrest system 80 can remain stationary even as the fall arrest arm 170 rotates.

Figure 15:
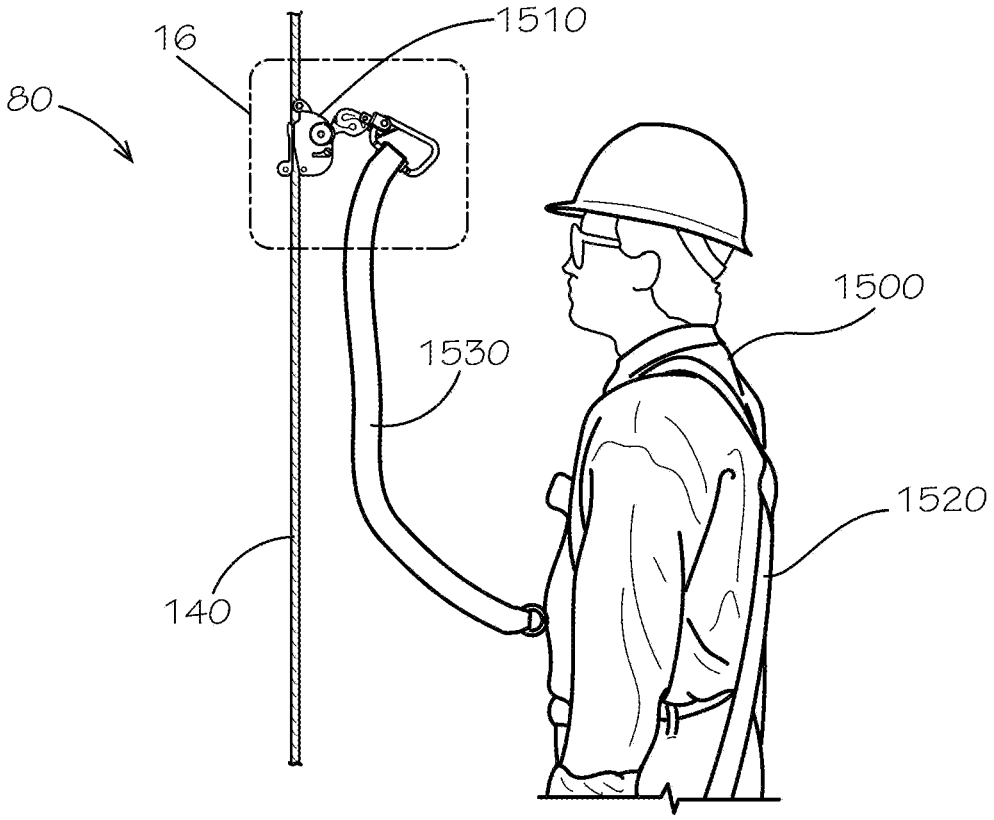
FIG. 15 is a side view of a user of the fall arrest system of FIG. 1 showing the user coupled to a cable of the fall arrest system with a detachable cable sleeve.

FIG. 15 is a side view of a user 1500 of the fall arrest system 80 showing the user coupled to the cable 140 of the fall arrest system 80 with a cam-locking cable traveler or cable sleeve 1510, which can be selectively received by and detachable from the cable 140 without tools. The user can wear a safety harness 1520 and secure the safety harness 1520 to the cable sleeve 1510. A connecting harness 1530 can connect the safety harness 1520 to the cable sleeve 1510. The cable 140 can be configured to allow movement of the cable sleeve 1510 to any position between the upper anchor 110 (shown in FIG. 1A) and the lower anchor 120 (shown in FIG. 1A).

Figure 16:
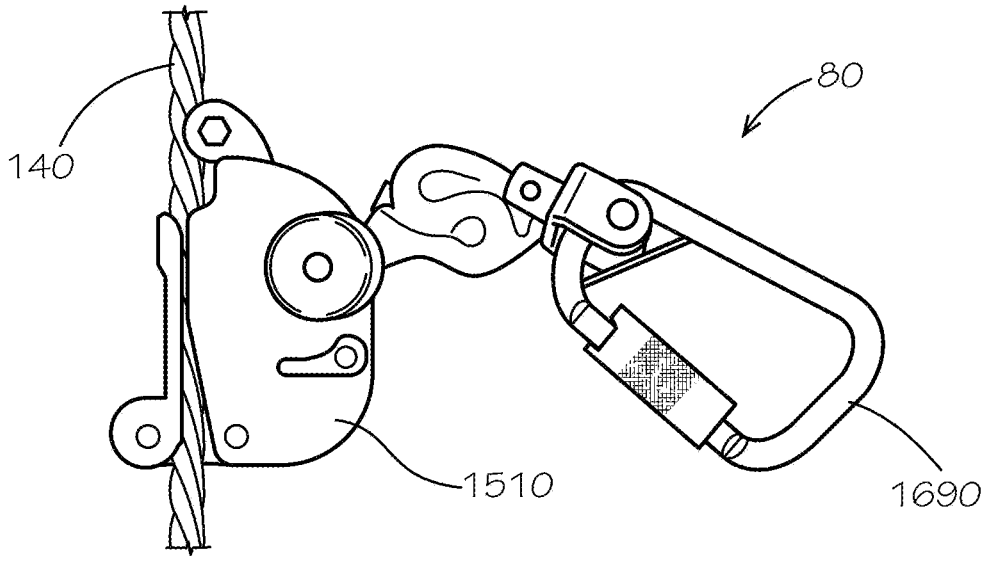
FIG. 16 is a side view of the cable sleeve of FIG. 15 taken from detail 16 of FIG. 15.

FIG. 16 is a side view of the cable sleeve 1510 of FIG. 15 taken from detail 16 of FIG. 15. As shown, the cable sleeve 1510 can comprise a connector 1690 such as, for example and without limitation, a carabiner. The connector 1690 can be configured to selectively engage and release the user from the cable sleeve 1510.

Figure 17:
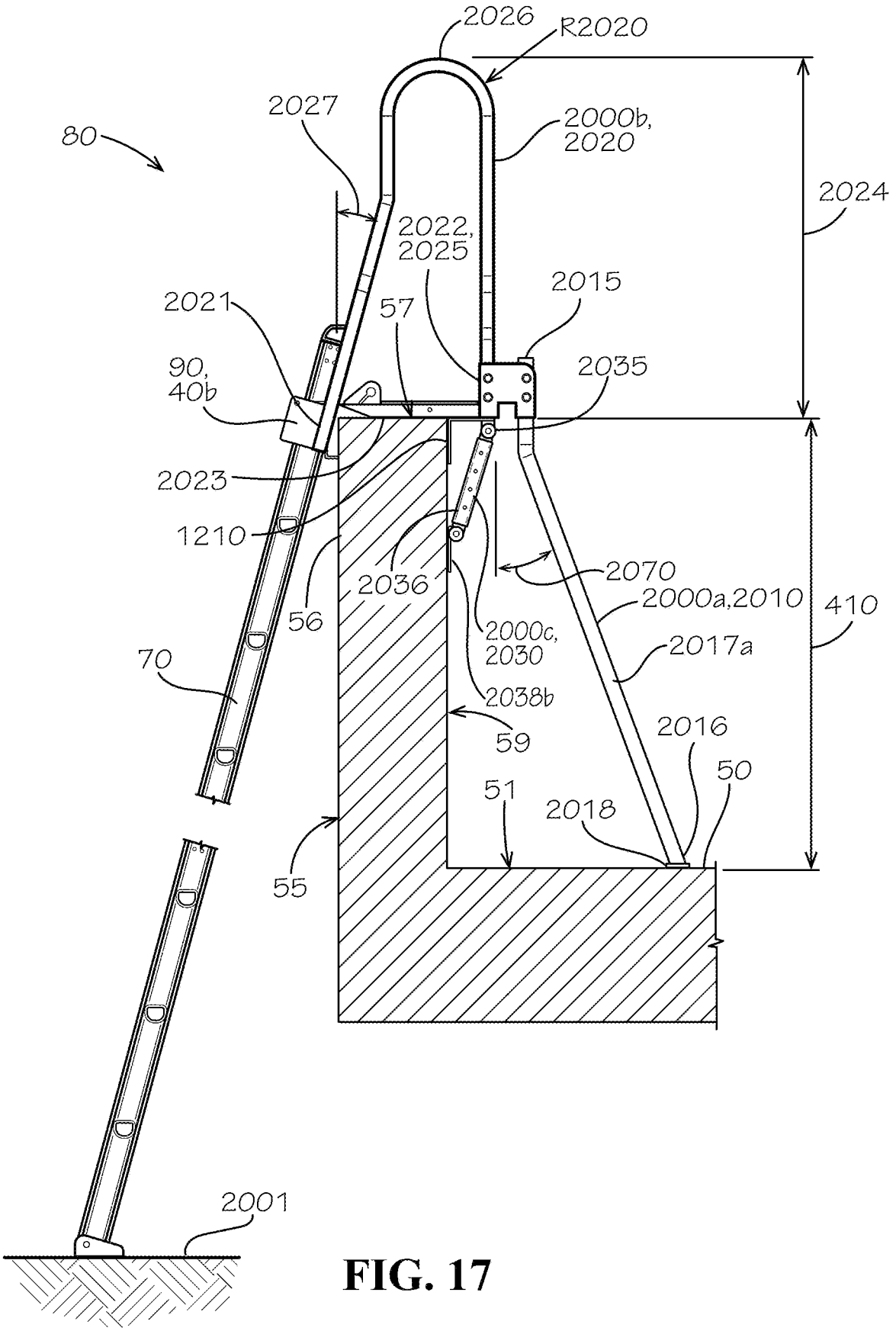
FIG. 17 is a side view of a fall arrest system comprising the ladder dock and a portion of the fall arrest device of FIG. 1 in accordance with another aspect of the current disclosure and further comprising the parapet descent apparatus of FIG. 14A but with a remaining portion of the fall arrest device removed for clarity.
Figure 18:
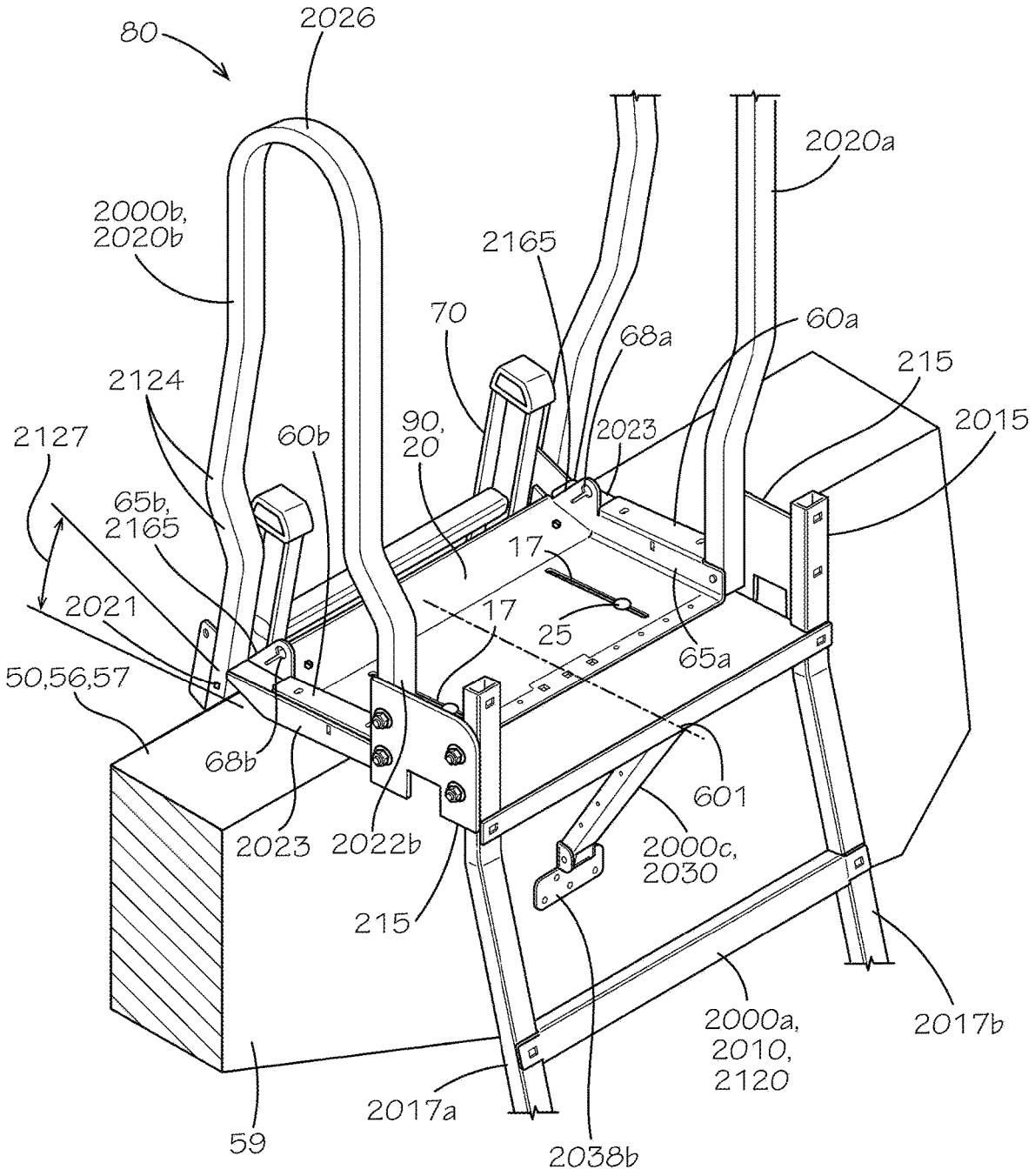
FIG. 18 is a rear perspective view of the fall arrest system, including the parapet descent apparatus of FIG. 17, again with a portion of the fall arrest device of the fall arrest system removed for clarity.

FIGS. 17 and 18 show the fall arrest system 80 in accordance with various aspects of the current disclosure. Again, the fall arrest system 80 can comprise the ladder 70, the ladder dock 90, and/or the fall arrest system 80 (shown in FIG. 1A). The fall arrest system 80 can further comprise parapet descent apparatuses 2000*a,b,c*, which are shown in an installed condition on the elevated structure 50 with a raised edge 56 shown as a parapet, which can define a wall height 410.

FIG. 17 is, more specifically, a side view of the fall arrest system 80. The parapet descent apparatus 2000*a* can be as shown in FIG. 14A. Portions of the fall arrest device 100 including the fall arrest arm 170 have been removed for clarity of the remaining structure. Each of the parapet descent apparatuses 2000*a,b,c* can be secured to the ladder dock 90 to facilitate a user's descent from a top surface 57 of the raised edge 56 down to the surface 51 of the elevated structure or down the ladder 70 to the lower surface 2001.

The parapet descent apparatus 2000*a* can comprise a parapet ladder 2010 extending from the top surface 57 of the parapet or raised edge 56 or from a position proximate to the top surface 57 of the parapet or raised edge 56 to the surface 51 of the elevated structure 50. The parapet ladder 2010 can define a first end 2015 proximate to the ladder dock 90 and a second end 2016 proximate to the surface 51. In some aspects, a portion of the parapet ladder 2010 between the first end 2015 and the second end 2016 can be angled with respect to the vertical by an angle 2070 to facilitate descent by a user. In some aspects, a portion of the parapet ladder 2010 between the first end 2015 and the second end 2016 can be oriented vertically. Feet 2018, which can be adjustable, can be attached to and can stabilize ladder rails 2017*a,b* (2017*b* shown in FIG. 18) and a base of the parapet ladder 2010 and the parapet ladder 2010 generally.

The parapet descent apparatus 2000*b* can comprise the guide rail 2020, which can extend vertically upward from the ladder dock 90. As shown, the guide rail 2020 can define the first end 2025 proximate to the ladder dock 90 and the second end 2026 distal from the ladder dock 90. The guide rail 2020 can define the rail height 2024 measured from the top surface 57, which can be set to satisfy applicable ergonomic and/or safety requirements. As shown, the first end 2025 of the guide rail 2020 can comprise two ends 2021,2022, either or both of which can be secured to the ladder dock 90. As shown, the end 2021 can be secured to the ear 40*b* with fasteners 2029 (shown in FIG. 1B), and the end 2022 can be secured with fasteners (not shown) to a portion of the ladder dock 90 distal from the ear 40*b*. The guide rail 2020 can approximately define an upside-down "U" shape or "V" shape. In some aspects, as shown, a horizontal member 2023 can extend from the end 2021 to the end 2022 and the guide rail 2020 can thereby form a closed shape. A portion of the guide rail 2020 proximate to the end 2021 can be angled with respect to the vertical by an angle 2027, and the second end 2026 or top of the guide rail 2020 can be rounded and can define a radius R2020 as shown.

The parapet descent apparatus 2000*c* can comprise the support arm 2030, which can stabilize the ladder dock 90. As shown, the support arm 2030 can define a first end 2035 proximate to the ladder dock 90 and a second end 2036 distal from the ladder dock 90. The support arm 2030 can support any loads applied to the ladder dock 90, including from the parapet ladder 2010 and when the ladder dock 90 overhangs at least in part in cantilever fashion past the raised edge 56 and beyond the top surface 57.

FIG. 18 is a rear perspective view of the fall arrest system 80, including the parapet descent apparatus 2000*a,b* of FIG. 17, again with portions of the fall arrest device 100 removed for clarity. The parapet ladder 2010 can comprise one or more rungs 2120 extending from the first ladder rail 2017*a* to the second ladder rail 2017*b*. As shown, the first end 2015 of the parapet ladder 2010 can be secured to guide rails 2020*a,b*, one of which can be positioned and secured on each side of the ladder dock 90, and, in some aspects as shown, through the brackets 215. As shown, guide rails such as either or both of the guide rails 2020*a,b* can define bends 2124 resulting in the second end 2026 or top portion of the guide rails 2020*a,b* being offset away from the centerline 601 of the ladder dock 90. Since a user of the fall arrest system 80 can be accompanied by tools or equipment, such an offset on one or both sides can facilitate passage across the ladder dock 90 from the ladder 70 to the parapet ladder 2010 and between the guide rails 2020*a,b* by increasing a space or distance between the guide rails 2020*a,b*. Positioning the upper anchor 110 outside of the space between the guide rails 2020*a,b* itself significantly facilitates passage of the user to and from the elevated structure 50.

As shown, in a similar way that the connecting panel 20 can be angled, an end of the horizontal member 2023 of the guide rail 2020*a* and any other of the guide rails 2020 can be angled with respect to the horizontal at an angle 2127 to provide clearance for a lip (not shown) on an edge of the elevated structure 50 and, more specifically, on the top surface 57. The ladder dock 90 can be secured to the horizontal member 2023 of each of the guide rails 2020*a,b* with fasteners (not shown) extending through the auxiliary panels 60*a,b* and the corresponding horizontal members 2023. As shown, the retaining openings 68*a,b* can be defined in the connecting panels 65*a,b* (65*b* shown in FIG. 11) and, more specifically, in tabs 2165 formed from same.

Any of the parapet descent apparatuses 2000*a,b,c* including, for example and without limitation, the parapet ladder 2010, the guide rails 2020*a,b*, the support arm 2030, and the ladder dock 90 can be formed at least in part from tubing members, which can be circular or, as shown, approximately square in cross-section (square except for radiused corners as shown), Each of the mounting brackets 2038*a,b* (2038*a* shown in FIG. 12) can be formed monolithically from a blank.

A method of using the fall arrest system 80 can comprise securing the upper anchor 110 (shown in FIG. 1A) of the fall arrest system 80 to the elevated structure 50. The method can comprise securing the lower anchor 120 to the ladder 70. In some aspects, securing the lower anchor 120 to the ladder 70 can comprise extending the ladder fastener 830, which can be the anchor rod, of the lower anchor 120 through the rung 72 of the ladder 70. More specifically, extending the ladder fastener 830 of the lower anchor 120 through the rung 72 of the ladder 70 can comprise extending the ladder fastener 830 of the lower anchor 120 completely through the rung 72 and locking the ladder fastener 830 such that the ladder fastener 830 cannot be removed without unlocking the ladder fastener 830. In some aspects, securing the lower anchor 120 to the ladder 70 can comprise extending a first ladder fastener 830 above and a second ladder fastener 830 below the rung 72 of the ladder 70 to lock a body 820 of the lower anchor to the rail 71*a,b* of the ladder 70 at the rung 72. The method can comprise securing the ladder 70 to the elevated structure 50 proximate to the upper anchor 110. The method can comprise extending the cable 140 (shown in FIG. 1A) from the upper anchor 110 to the lower anchor 120 (shown in FIG. 1A) of the fall arrest system 80. More specifically, the cable 140 can be configured to receive the cable sleeve 1510 (shown in FIG. 15). The method can comprise tethering the user 1500 to the cable 140. The method can comprise the cable 140 allowing movement of the cable sleeve 1510 to any position between the upper anchor 110 and the lower anchor 120. The method can comprise arresting a fall of the user 1500 tethered to the cable 140 by loading the torsion biasing element 150 of the upper anchor 110.

The method can comprise applying only a downward force or minimizing any upward force on the elevated structure 50 through the ladder dock 90 at each portion of the ladder dock 90 in contact with the top surface 57 of the elevated structure 50 when loading the fall arrest device 100 through the upper anchor 110. Applying only such a downward force or minimizing such an upward force can, for example and without limitation, be achieved by passing the cable 140 over the cable guide 180 and keeping contact point between the cable 140 and the roller 185 directly over the top surface 57, contacting the elevated structure 50 with the stop panel 1410, securing the bracket 1210 to the elevated structure 50 with one or more fasteners, and/or securing the mounting bracket 2038*b* to the elevated structure 50 with one or more fasteners. More specifically, for example only, a moment tending to rotating the upper anchor in a counterclockwise direction in the loaded condition shown in FIG. 14B will be offset by a moment in the clockwise direction acting on the stop panel 1410 (shown in FIG. 14A) at the surface 55. Similarly, attaching the bracket 1210 to the elevated structure 50 with one or more fasteners will result in a similar clockwise moment tending to offset or cancel the moment produced by the cable such that any remaining force tending to lift the ladder dock 90 will be minimized or made zero. As such, the fall arrest device 100 tends not to pull the upper anchor 110 or the ladder dock 90 away from or off the elevated structure 50 with an upward-acting load on a rear edge of the ladder dock 90 and instead generally acts downward on the elevated structure 50, especially with the upper anchor in a full loaded condition.

The method can comprise securing the cable 140 inside a cable attachment 160 of the lower anchor 120. More specifically, the method can comprise securing and, as desired, tightening a cable fastener 890 of the cable attachment 160 to create, as desired, increased tension in the cable 140. The method can comprise securing a position of a portion of the cable 140 relative to the lower anchor 120 with one or more of a first portion 892, a second portion 894, a third portion 896, a fourth portion 895, and the locking fasteners 898 of the cable fastener 890. The method can comprise securing the lower anchor 120 to the ladder 70 to prevent movement of the lower anchor 120 with respect to the ladder 70 in a longitudinal direction of the ladder 70.

It is contemplated that the upper anchor 110 can be used with a lower anchor other than the lower anchor 120 specifically disclosed, and the lower anchor 120 can be used with an upper anchor other than the upper anchor 110 specifically disclosed. And the upper anchor 110 and the lower anchor 120 can be used with a ladder dock 90 other than the ladder dock 90 specifically disclosed. While a leaning and portable ladder 70 is shown in the figures, the disclosed fall arrest system 80 and, in particular, a portion or all of the fall arrest device 100 can be installed on a ladder that is fixed to the elevated structure 50 or to a separate structure providing access to the elevated structure 50. The ladder 70, as a portable ladder, can provide temporary access to the elevated structure 50 in that it can be selectively positioned against the elevated structure 50 and then, after it is no longer needed, easily stored elsewhere.

Any of the structures of the fall arrest system 80 can be formed from a non-metallic material such as, for example and without limitation, a reinforced fiberglass or polymer or from a metallic material such as steel. A paint coating or powder coating or use of corrosion resistant materials (e.g., galvanized or stainless steel) can facilitate use of the fall arrest system 80 for extended periods outside without degradation. A portion of or all of the fall arrest system 80 can define a surface texture such as a diamond tread pattern for aesthetic reasons or for functional reasons such as to improve skid resistance.

One should note that conditional language, such as, among others, "can," "could," "might," or "may," unless specifically stated otherwise, or otherwise understood within the context as used, is generally intended to convey that certain aspects include, while other aspects do not include, certain features, elements and/or steps. Thus, such conditional language is not generally intended to imply that features, elements and/or steps are in any way required for one or more particular aspects or that one or more particular aspects necessarily comprise logic for deciding, with or without user input or prompting, whether these features, elements and/or steps are included or are to be performed in any particular aspect.

It should be emphasized that the above-described aspects are merely possible examples of implementations, merely set forth for a clear understanding of the principles of the present disclosure. Any process descriptions or blocks in flow diagrams should be understood as representing modules, segments, or portions of code which comprise one or more executable instructions for implementing specific logical functions or steps in the process, and alternate implementations are included in which functions may not be included or executed at all, may be executed out of order from that shown or discussed, including substantially concurrently or in reverse order, depending on the functionality involved, as would be understood by those reasonably skilled in the art of the present disclosure. Many variations and modifications may be made to the above-described aspect(s) without departing substantially from the spirit and principles of the present disclosure. Further, the scope of the present disclosure is intended to cover any and all combinations and sub-combinations of all elements, features, and aspects discussed above. All such modifications and variations are intended to be included herein within the scope of the present disclosure, and all possible claims to individual aspects or combinations of elements or steps are intended to be supported by the present disclosure.

That which is claimed is:

1. A fall arrest system comprising:

a ladder dock comprising guide rails secured to and extending vertically upward from the ladder dock when the ladder dock is mounted to a horizontal surface, the guide rails defining a passage therebetween configured for a user of the system to traverse the ladder dock, the guide rails being configured to steady the user during traversal of the passage; and a fall arrest device secured to the ladder dock and comprising:

a fall arrest base comprising a torsion biasing element defining an axis;

a fall arrest arm comprising an assembled frame comprising a plurality of frame members, the plurality of frame members joined to each other and together defining a closed shape when viewed along the axis of the torsion biasing element, the closed shape defining an opening bounded by the plurality of frame members, the fall arrest arm rotatably secured to the torsion biasing element of the fall arrest base, the fall arrest arm biased towards an unloaded position of the fall arrest arm by the torsion biasing element and configured to rotate about the axis of the torsion biasing element and against the bias of the torsion biasing element when the fall arrest arm is loaded towards a loaded position; and a fastener securing the fall arrest arm to the fall arrest base.

2. The system of claim 1, wherein the torsion biasing element comprises:

a housing;

a torsion shaft positioned inside the housing, a cross-section of the torsion shaft defining a polygon with at least three sides; and at least three cords, each of the at least three cords comprising a resilient material, each of the at least three cords positioned adjacent to and in contact with one of the at least three sides of the torsion shaft and positioned inside a cavity defined between the torsion shaft and the housing, a total quantity of the at least three cords equaling a total number of the at least three sides.

3. The system of claim 1, wherein a range of movement of the fall arrest arm against the biasing of the torsion biasing element is at least 30 degrees.

4. The system of claim 1, further comprising a cable guide, the cable guide positioned and configured to hold a fall arrest cable extending from an attachment portion of the fall arrest arm and around the cable guide and away from the fall arrest arm.

5. The system of claim 4, wherein the cable guide comprises a roller configured to rotate about an axis of the roller.

6. The system of claim 1, wherein the frame defines a polygonal shape when viewed along the axis of the torsion biasing element.

7. The system of claim 6, wherein the frame defines one of a triangular shape and a quadrilateral shape when viewed along the axis of the torsion biasing element.

8. The system of claim 1, wherein an upper anchor comprises the fall arrest base extends across at least a portion of the passage.

9. The system of claim 8, wherein, the fall arrest device further comprising a lower anchor configured to be secured to a lower end of the ladder, and wherein, the lower anchor comprises a ladder fastener configured to secure a body of the lower anchor to the ladder and a cable fastener configured to secure the ladder fastener to a fall arrest cable.

10. A fall arrest system comprising:

a ladder dock comprising a planar mounting panel formed from a blank and configured to be mounted to an elevated structure, the mounting panel extending from a center line of the ladder dock towards each of two opposite sides of the ladder dock, the ladder dock defining a notch sized to receive an entire width of a ladder and fix a position of a ladder with respect to the ladder dock when the ladder is leaned against the ladder dock and received within the notch, the ladder dock configured to remain stationary while the ladder separates from and is able to rotate with respect to the ladder dock after removal of any retaining fastener configured to prevent such rotation during use of the ladder dock; and a fall arrest device secured to the ladder dock and comprising:

a fall arrest base comprising a torsion biasing element defining an axis, the fall arrest base secured to the ladder dock, the torsion biasing element extending across at least a portion of a passage configured for a user of the system to traverse the ladder dock without impeding traversal of the passage; and a fall arrest arm rotatably secured to the torsion biasing element of the fall arrest base, the fall arrest arm biased towards an unloaded position of the fall arrest arm by the torsion biasing element and configured to rotate about the axis of the torsion biasing element and against the bias of the torsion biasing element when the fall arrest arm is loaded towards a loaded position.

11. The system of claim 10, further comprising a rigid, portable ladder.

12. The system of claim 10, wherein the ladder dock is configured to be mounted to a substantially horizontal surface of the elevated structure, a lower surface of the mounting panel contacting the substantially horizontal surface of the elevated structure.

13. The system of claim 10, wherein the torsion biasing element comprises:

a housing;

a torsion shaft positioned inside the housing, a cross-section of the torsion shaft defining a polygon with at least three sides; and at least three cords, each of the at least three cords comprising a resilient material, each of the at least three cords positioned adjacent to and in contact with one of the at least three sides and positioned inside a cavity defined between the torsion shaft and the housing, a total quantity of the at least three cords equaling a total number of the at least three sides.

14. The system of claim 10, wherein the fall arrest arm of the fall arrest device is positioned outside of the passage defined at least in part by a guardrail and configured for passage of the user of the system.

* * * * *